US011688324B2

(12) United States Patent
Yi et al.

(10) Patent No.: US 11,688,324 B2
(45) Date of Patent: Jun. 27, 2023

(54) DISPLAY PANEL AND DISPLAY DEVICE

(71) Applicant: Wuhan China Star Optoelectronics Semiconductor Display Technology Co., Ltd., Hubei (CN)

(72) Inventors: Chujun Yi, Hubei (CN); Tao Chen, Hubei (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 268 days.

(21) Appl. No.: 17/287,126

(22) PCT Filed: Mar. 31, 2021

(86) PCT No.: PCT/CN2021/084611
§ 371 (c)(1),
(2) Date: Apr. 21, 2021

(87) PCT Pub. No.: WO2022/188222
PCT Pub. Date: Sep. 15, 2022

(65) Prior Publication Data

US 2023/0154374 A1 May 18, 2023

(30) Foreign Application Priority Data

Mar. 10, 2021 (CN) ..... 202110259569.X

(51) Int. Cl.
*G09G 3/20* (2006.01)
*G09G 3/32* (2016.01)

(52) U.S. Cl.
CPC ..... *G09G 3/2074* (2013.01); *G09G 3/32* (2013.01); *G09G 2300/0426* (2013.01);
(Continued)

(58) Field of Classification Search
CPC ..... G09G 3/2074; G09G 3/32; G09G 2300/0426; G09G 2300/0819;
(Continued)

(56) References Cited

U.S. PATENT DOCUMENTS

2013/0265515 A1 10/2013 Hasegawa et al.
2018/0197483 A1* 7/2018 Tanikame ..... G09G 5/001
(Continued)

FOREIGN PATENT DOCUMENTS

CN 109599052 4/2019
CN 110459175 11/2019
(Continued)

*Primary Examiner* — Andrew Sasinowski

(57) ABSTRACT

A display panel and a display device are provided. In the display panel, each composite pixel row includes a plurality of auxiliary sub-pixels disposed in a functional additional area and a plurality of main sub-pixels disposed in a main display area. Each of auxiliary pixel drive circuita is connected to a plurality of auxiliary sub-pixels. Each of main pixel drive circuits is connected to a corresponding main sub-pixel. A plurality of stages of gate drive circuits are correspondingly connected to the plurality of auxiliary pixel drive circuits and the plurality of main pixel drive circuits through a plurality of scanning signal lines to improve a display mismatch problem.

20 Claims, 13 Drawing Sheets

(52) U.S. Cl.
CPC ..... *G09G 2300/0819* (2013.01); *G09G 2300/0842* (2013.01); *G09G 2310/0202* (2013.01); *G09G 2310/0267* (2013.01); *G09G 2310/0281* (2013.01)

(58) Field of Classification Search
CPC ... G09G 2300/0842; G09G 2310/0202; G09G 2310/0267; G09G 2310/0281
See application file for complete search history.

(56) References Cited

U.S. PATENT DOCUMENTS

| | | | | |
|---|---|---|---|---|
| 2020/0410916 | A1* | 12/2020 | Ouyang | G11C 19/28 |
| 2021/0241672 | A1* | 8/2021 | Gao | G09G 3/2003 |
| 2021/0319742 | A1* | 10/2021 | Feng | G09G 3/3677 |
| 2022/0084460 | A1* | 3/2022 | Shi | G09G 3/3225 |
| 2022/0122541 | A1* | 4/2022 | Chung | G09G 3/3266 |
| 2022/0270530 | A1* | 8/2022 | Wang | G09G 3/3241 |
| 2022/0310021 | A1* | 9/2022 | Feng | G11C 19/28 |

FOREIGN PATENT DOCUMENTS

| | | |
|---|---|---|
| CN | 111508416 | 8/2020 |
| CN | 111554227 | 8/2020 |
| CN | 111833796 | 10/2020 |
| CN | 111951687 | 11/2020 |
| CN | 112103329 | 12/2020 |
| JP | 2001-100690 | 4/2001 |

* cited by examiner

DISPLAY PANEL AND DISPLAY DEVICE

RELATED APPLICATIONS

This application is a National Phase of PCT Patent Application No. PCT/CN2021/084611 having International filing date of Mar. 31, 2021, which claims the benefit of priority of Chinese Patent Application No. 202110259569.X filed on Mar. 10, 2021. The contents of the above applications are all incorporated by reference as if fully set forth herein in their entirety.

FIELD AND BACKGROUND OF THE INVENTION

The present disclosure relates to the field of display technologies, in particular to a display panel and a display device.

When using a camera under panel (CUP) technology, in order to reduce an influence of pixel drive circuits that drive pixels in a CUP area on the CUP area, one of the pixel drive circuits will simultaneously drives a plurality of sub-pixels in the CUP area. However, control signal lines used by the pixel driving circuits for driving the sub-pixels in the CUP area to emit light will not match control signal lines used by the pixel driving circuits for driving pixels in a main display area to emit light, resulting in a display mismatch problem.

SUMMARY OF THE INVENTION

Embodiments of the present disclosure provide a display panel and a display device which can improve a display mismatch problem of the displat panel caused by that scanning signal lines connected to auxiliary pixel drive circuit and main pixel drive circuit corresponding to auxiliary sub-pixel and main sub-pixel of a same composite pixel row do not match.

An embodiment of the present disclosure provides a display panel. The display panel includes a functional additional area and a main display area disposed on a periphery of the functional additional area. The display panel includes a plurality of pixel rows, a plurality of auxiliary pixel drive circuits, a plurality of main pixel drive circuits, and a plurality of stages of gate drive circuits.

The plurality of pixel rows includes a plurality of composite pixel rows. Each of the composite pixel rows includes a plurality of auxiliary sub-pixels disposed in the functional additional area and a plurality of main sub-pixels disposed in the main display area. Each of the auxiliary pixel drive circuits is connected to the plurality of auxiliary sub-pixels to correspondingly drive the plurality of auxiliary sub-pixels to emit light. Each of the main pixel drive circuits is connected to a corresponding main sub-pixel to drive the corresponding main sub-pixels to emit light. The plurality of stages of gate drive circuits are correspondingly connected to the plurality of auxiliary pixel drive circuits and the plurality of main pixel drive circuits through a plurality of scanning signal lines.

Scanning signal lines connected to the auxiliary pixel drive circuit and the main pixel drive circuit corresponding to the auxiliary sub-pixel and the main sub-pixel arranged on a same composite pixel row are different.

Another embodiment of the present disclosure also provides a display device including any one of above-mentioned display panel.

In comparison with the prior art, the embodiments of the present disclosure provide the display panel and the display device, the display panel includes the functional additional area and the main display area disposed on a periphery of of the functional additional area, and the display panel includes the plurality of pixel rows, the plurality of composite pixel rows, the plurality of auxiliary pixel drive circuits, the plurality of main pixel drive circuits, and the plurality of stages of gate drive circuits. The plurality of pixel rows includes the plurality of composite pixel rows. Each of the composite pixel rows includes the plurality of auxiliary sub-pixels disposed in the functional additional area and the plurality of main sub-pixels disposed in the main display area. Each of the auxiliary pixel drive circuits is connected to the plurality of auxiliary sub-pixels to correspondingly drive the plurality of auxiliary sub-pixels to emit light. Each of the main pixel drive circuits is connected to a corresponding main sub-pixel to drive the corresponding main sub-pixels to emit light. The plurality of stages of gate drive circuits are correspondingly connected to the plurality of auxiliary pixel drive circuits and the plurality of main pixel drive circuits through plurality of scanning signal lines. The scanning signal lines connected to the auxiliary pixel drive circuit and the main pixel drive circuit corresponding to the auxiliary sub-pixel and the main sub-pixel arranged on a same composite pixel row are different. A display mismatch problem of the displat panel caused by that the scanning signal lines connected to the auxiliary pixel drive circuit and the main pixel drive circuit corresponding to the auxiliary sub-pixel and the main sub-pixel of the same composite pixel row do not match is improved.

DESCRIPTION OF SPECIFIC EMBODIMENTS OF THE INVENTION

In order to make purposes, technical solutions, and effects of the present disclosure specific and clear, the present disclosure will be further described in detail below with reference to the accompanying drawings and embodiments. It should be understood that the specific embodiments described herein are only used to explain the present disclosure, and are not used to limit the present disclosure.

Figure 1A:
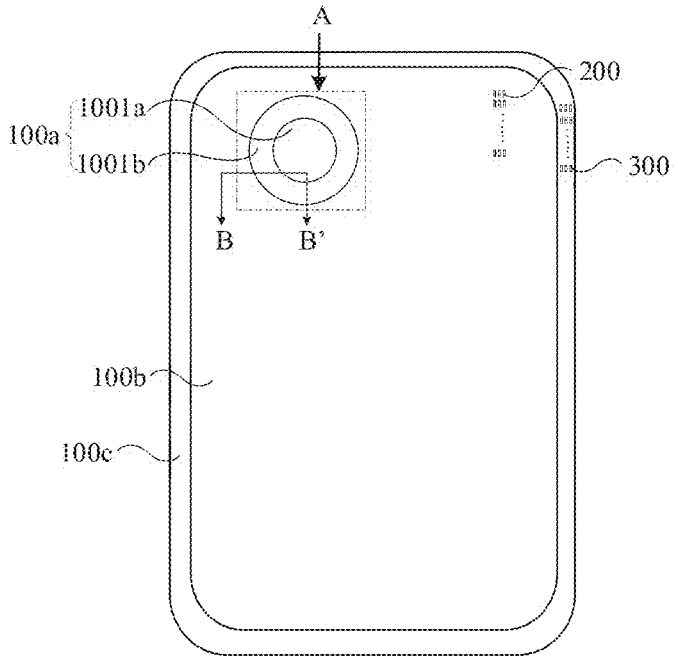
FIG. 1A is a schematic diagram of a display panel of an embodiment of the present disclosure.
Figure 1B:
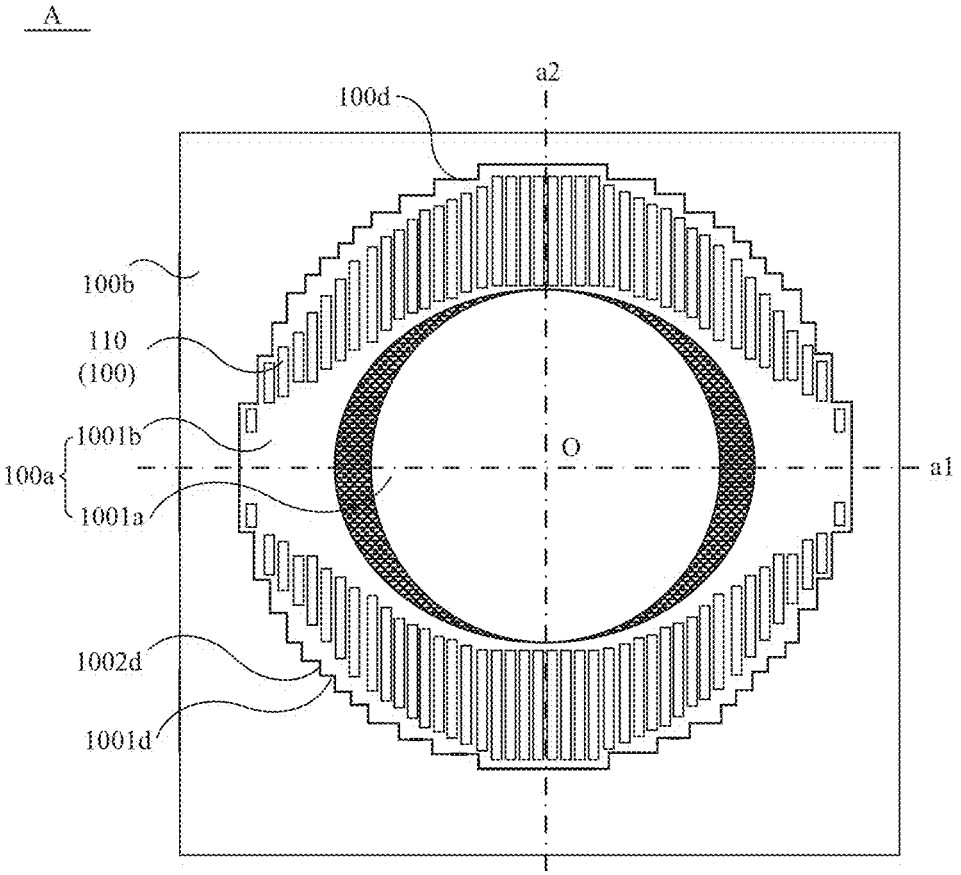
FIG. 1B is a partial enlarged view of an A portion in FIG. 1A.
Figure 2A:
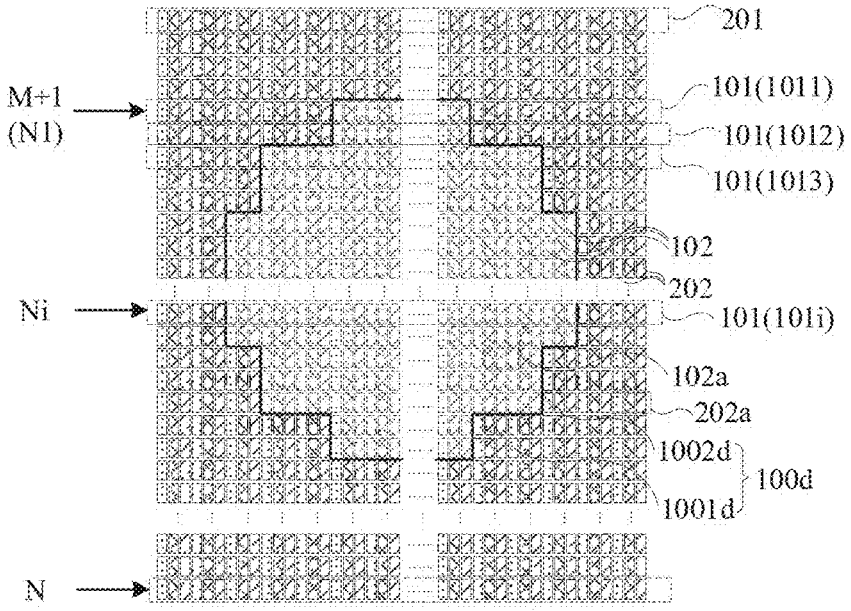
FIG. 2A to FIG. 2B are schematic diagrams of arrangements of auxiliary sub-pixels and main sub-pixels of the embodiment of the present disclosure.
Figure 2B:
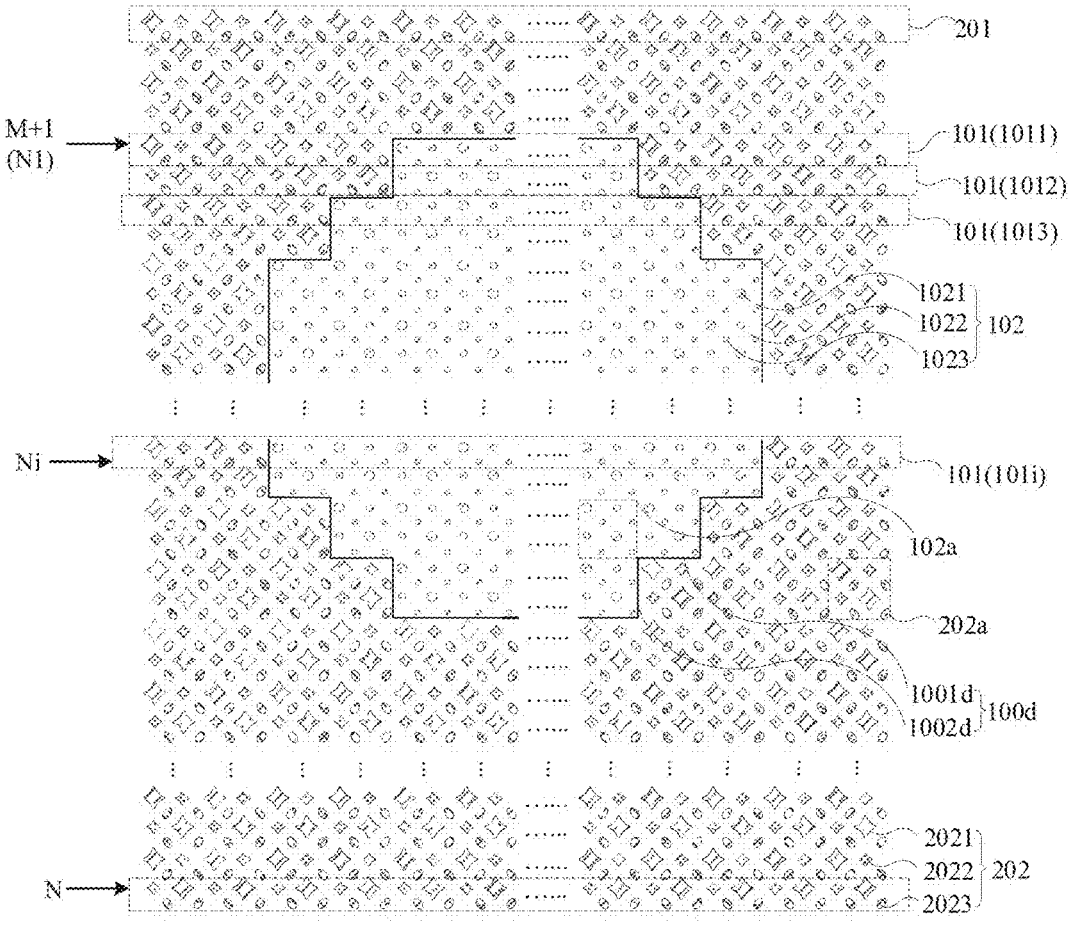

Specifically, please refer to FIG. 1A, which is a schematic diagram of a display panel of an embodiment of the present disclosure. FIG. 1B is a partial enlarged view of an A portion in FIG. 1A. FIG. 2A to FIG. 2B are schematic diagrams of arrangements of auxiliary sub-pixels and main sub-pixels of the embodiment of the present disclosure.

The embodiment of the present disclosure provides a display panel. The display panel includes a functional additional area 100*a*, a main display area 100*b*, and a non-display area 100*c*. The main display area 100*b* is disposed on a periphery of the functional additional area 100*a*. The non-display area 100*c* is disposed on a periphery of the main display area 100*b*. The functional additional area 100*a* includes a display and light transmitting area 1001*a* and a transition display area 1001*b* disposed on a periphery of the display and light transmitting area 1001*a*.

Alternatively, the display panel may include a plurality of functional additional area 100*a*. A shape of each functional additional area 100*a* in a top view includes, but is not limited to, a circle, a rectangle, and a rectangle with rounded corners.

Please refer to FIG. 1A to FIG. 1B and FIG. 2A to FIG. 2B. The display panel includes a plurality of pixel rows, a plurality of auxiliary pixel drive circuits 100, a plurality of main pixel drive circuits 200, and a plurality of stages of gate drive circuits 300.

The plurality of pixel rows include a plurality of composite pixel rows 101 and a plurality of main pixel rows 201. Each of the composite pixel rows 101 includes a plurality of auxiliary sub-pixels 102 disposed in the functional additional area 100*a* and a plurality of main sub-pixels 202 disposed in the main display area 100*b*. Each of the main pixel rows 201 includes the plurality of main sub-pixels 202 disposed in the main display area 100*b*.

Each of the auxiliary pixel drive circuits 100 is connected to the plurality of auxiliary sub-pixels 102 for driving the plurality of auxiliary sub-pixels 102 to emit light. The plurality of auxiliary pixel drive circuits 100 are disposed in the functional additional area 100*a*. Furthermore, the plurality of auxiliary pixel drive circuits 100 are disposed in the transition display area 1001*b*. Specifically, referring to FIG. 1B, the transition display area 1001*b* is provided with a plurality of pixel driving circuit islands 110. The plurality of pixel driving circuit islands 110 are arranged along an edge of the display and light transmitting area 1001*a*. Each of the pixel driving circuit islands 110 includes a plurality of auxiliary pixel drive circuits 100. The plurality of auxiliary pixel drive circuits 100 driving the plurality of auxiliary sub-pixels 102 disposed in the functional additional area 100*a* to emit light are integrated as the pixel driving circuit islands 110 and disposed in the transition display area 1001*b*. Thus, a light transmittance of the display and light transmitting area 1001*a* is improved.

The plurality of main pixel drive circuits 200 are disposed in the main display area 100*b*. Each of the main pixel drive circuits 200 is connected to a corresponding main sub-pixel 202 for driving the corresponding main sub-pixel 202 to emit light.

The plurality of stages of gate drive circuits 300 are disposed in the non-display area 100*c*. The plurality of stages of gate drive circuits 300 are correspondingly connected to the plurality of auxiliary pixel drive circuits 100 and the plurality of main pixel drive circuits 200 through the plurality of scanning signal lines, for providing scanning signals to the auxiliary pixel drive circuits 100 and the plurality of main pixel drive circuits 200.

Scanning signal lines connected to the auxiliary pixel drive circuit 100 and the main pixel drive circuit 200 corresponding to the auxiliary sub-pixel 102 and the main sub-pixel 202 arranged on a same composite pixel row are different. It improves the display panel to have a display mismatch problem caused by that when the auxiliary pixel drive circuits 100 and the main pixel drive circuits 200 correspondingly drive the auxiliary sub-pixels 102 in the functional additional area 100*a* and the main sub-pixels 202 in the main display area 100*b* to emit light, a light emission of the main sub-pixels 202 and a light emission of the auxiliary sub-pixels 102 in the same composite pixel row 101 do not match.

Alternatively, the auxiliary sub-pixels 102 and the main sub-pixels 202 include organic light-emitting diodes, miniature light-emitting diodes, and sub-millimeter light-emitting diodes.

Alternatively, the plurality of main sub-pixels 202 arranged on a same pixel row, or the plurality of main sub-pixels 202 and the plurality of auxiliary sub-pixels 102 arranged on a same pixel row may be arranged on a same horizontal line. That is, as shown in FIG. 2A, the plurality of main sub-pixels 202 arranged on a same main pixel row 201 are arranged on a same horizontal line. The plurality of main sub-pixels 202 and the plurality of auxiliary sub-pixels 102 arranged on a same composite pixel row 101 are arranged on a same horizontal line.

Alternatively, a part of the main sub-pixels in the plurality of main sub-pixels 202 arranged on a same pixel row, or a part of the main sub-pixels in the plurality of main sub-pixels 202 and a part of the auxiliary sub-pixels in the plurality of auxiliary sub-pixels 102 arranged on a same pixel row are arranged on a same horizontal line. That is, as shown in FIG. 2B, a part of the main sub-pixels in the plurality of main sub-pixels 202 arranged on a same main pixel row 201 are arranged on a same horizontal line. A part of the main sub-pixels in the plurality of main sub-pixels 202 and a part of the auxiliary sub-pixels in the plurality of auxiliary sub-pixels 102 arranged on a same composite pixel row 101 are arranged on a same horizontal line.

Specifically, please refer to FIG. 2B, the plurality of main sub-pixels 202 includes a plurality of first main sub-pixels 2021, a plurality of second main sub-pixels 2022, and a plurality of third main sub-pixels 2023 with different luminous colors. The plurality of auxiliary sub-pixels 102 includes a plurality of first auxiliary sub-pixels 1021, a plurality of second auxiliary sub-pixels 1022, and a plurality of third auxiliary sub-pixels 1023. The first auxiliary sub-pixels 1021 and the first main sub-pixels 2021 emit light of a same color. The second auxiliary sub-pixels 1022 and the second main sub-pixels 2022 emit light of a same color. The third auxiliary sub-pixels 1023 and the third main sub-pixels 2023 emit light of a same color. The plurality of first main sub-pixels 2021 and the plurality of second main sub-pixels

2022 arranged on a same main pixel row 201 are arranged on a same horizontal line. The plurality of third main sub-pixels 2023 are arranged on another same horizontal line. The plurality of first main sub-pixels 2021, the plurality of second main sub-pixels 2022, the plurality of first auxiliary sub-pixels 1021, and the plurality of second auxiliary sub-pixels 1022 arranged on a same composite pixel row 101 are arranged on a same horizontal line. The plurality of third main sub-pixels 2023 and the plurality of third auxiliary sub-pixels 1023 are arranged on another same horizontal line.

Alternatively, luminous colors of the first main sub-pixels 2021, the second main sub-pixels 2022, and the third main sub-pixels 2023 include red, blue, green, yellow, white, etc. Furthermore, the luminous color of the first main sub-pixels 2021 is blue. The luminous color of the second main sub-pixels 2022 is red. The luminous color of the third main sub-pixels 2023 is green.

Furthermore, please refer to FIG. 2A to FIG. 2B. An arrangement structure of the plurality of auxiliary sub-pixels 102 disposed in the functional additional area 100*a* is the same as an arrangement structure of the plurality of main sub-pixels 202 disposed in the main display area 100*b*. Without increasing a difficulty of a manufacturing process, a display difference between the main display area 100*b* and the functional additional area 100*a* can be further reduced, and the display mismatch problem of the display panel can be further improved.

Specifically, the display panel includes a plurality of main pixel units 202*a* and a plurality of auxiliary pixel units 102*a*. Each of the main pixel units 202*a* includes the plurality of main sub-pixels 202. Each of the auxiliary pixel units 102*a* includes the plurality of auxiliary sub-pixels 102. A number of the main sub-pixels 202 included in each main pixel unit 202*a* and an arrangement of the plurality of main sub-pixels 202 are the same as and a number of the auxiliary sub-pixels 102 included in each auxiliary pixel unit 102*a* and an arrangement of the plurality of auxiliary sub-pixels 102.

Alternatively, each of the main pixel units 202*a* includes the first main sub-pixels 2021, the second main sub-pixels 2022, and the third main sub-pixels 2023. Each of the auxiliary pixel units 102*a* includes the first auxiliary sub-pixels 1021, the second auxiliary sub-pixels 1022, and the third auxiliary sub-pixels 1023. Two adjacent main pixel units 202*a* are arranged in a mirror image arrangement and symmetry to one another in the main display area 100*b*. Two adjacent auxiliary pixel units 102*a* are correspondingly arranged in a mirror image arrangement and symmetry to one another in the auxiliary display area 100*a*.

Furthermore, the first main sub-pixels 2021, the second main sub-pixels 2022, and the third main sub-pixels 2023 may adopt a standard RGB arrangement, or may adopt an arrangement form such as a pearl arrangement. Correspondingly, the first auxiliary sub-pixels 1021, the second auxiliary sub-pixels 1022, and the third auxiliary sub-pixels 1023 adopt a standard RGB arrangement, or adopt an arrangement form such as a pearl arrangement.

Alternatively, at least one of the first main sub-pixels 2021, at least one of the second main sub-pixels 2022, and at least one of the third main sub-pixels 2023 arranged on a same main pixel unit 202*a* are arranged in a same pixel row 201. At least one of the first auxiliary sub-pixels 1021, at least one of the second auxiliary sub-pixels 1022, and at least one of the third auxiliary sub-pixels 1023 arranged on a same auxiliary pixel unit 102*a* are arranged in a same pixel row 201.

Alternatively, the main pixel units 202*a* may also include fourth main sub-pixels, etc., and the auxiliary pixel units 102*a* may also include fourth auxiliary sub-pixels, etc.

Referring to FIG. 1B and FIG. 2A to FIG. 2B, there is a bending line boundary 100*d* between the main display area 100*b* and the functional additional area 100*a*. The bending line boundary 100*d* includes a plurality of first bending sides 1001*d* and a plurality of second bending sides 1002*d* that intersect perpendicularly to one another. The functional additional area 100*a* includes a first symmetry axis a1 parallel to the first bending sides 1001*d* and a second symmetry axis a2 parallel to the second bending sides 1002*d* and intersecting with the first symmetry axis a1. An intersection point O of the first symmetry axis a1 and the second symmetry axis a2 is disposed at a center of the functional additional area 100*a*. Each of the first bending side 1001*d* and each of the second bending side 1002*d* that intersect perpendicularly to one another correspond to at least one of the auxiliary pixel units 102*a*, so as to ensure a structural integrity of the auxiliary pixel unit 102*a* close to the bending line boundary 100*d*. A display difference between the main display area 100*b* and the functional additional area 100*a* close to the bending line boundary 100*d* is reduced.

Furthermore, each of the first bending sides 1001*d* has a first length. The first lengths of the plurality of first bending side 1001*d* sequentially decrease in a direction away from the second symmetry axis a2. Each of the second bending sides 1002*d* has a first height. The first heights of the plurality of second bending side 1002*d* sequentially decrease in a direction away from the first symmetry axis a1.

Referring to FIG. 1A to FIG. 1B and FIG. 2A to FIG. 2B, the plurality of main sub-pixels 202 disposed in the main pixel rows 201 can be driven by the corresponding main pixel drive circuits 200 to emit light. The plurality of composite pixel rows 101 are adjacent to the plurality of main pixel rows 201. Specifically, the plurality of main pixel rows 201 may be disposed on at least one side of the plurality of composite pixel rows 101. Furthermore, the plurality of composite pixel rows 101 may be disposed between the plurality of main pixel rows 201, as shown in FIG. 2A to FIG. 2B. That is, the plurality of composite pixel rows 101 may be arranged in front of a first main pixel row of the plurality of main pixel rows 201. Alternatively, the plurality of composite pixel rows 101 may be arranged behind a last main pixel row of the plurality of main pixel rows 201. Alternatively, the plurality of composite pixel rows 101 may be arranged in front of one of the plurality of main pixel rows 201.

Figure 3A:
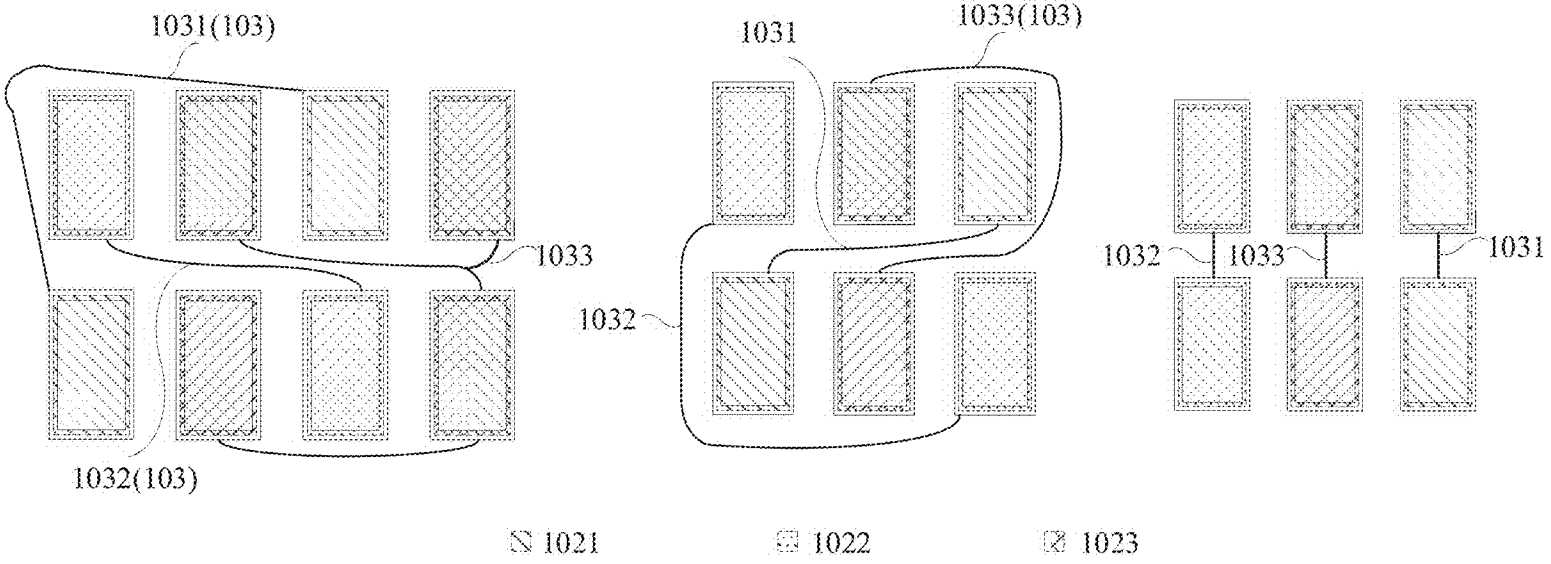
FIG. 3A to FIG. 3B are schematic diagrams of electrical connections of a plurality of auxiliary sub-pixels of the embodiment of the present disclosure.
Figure 3B:
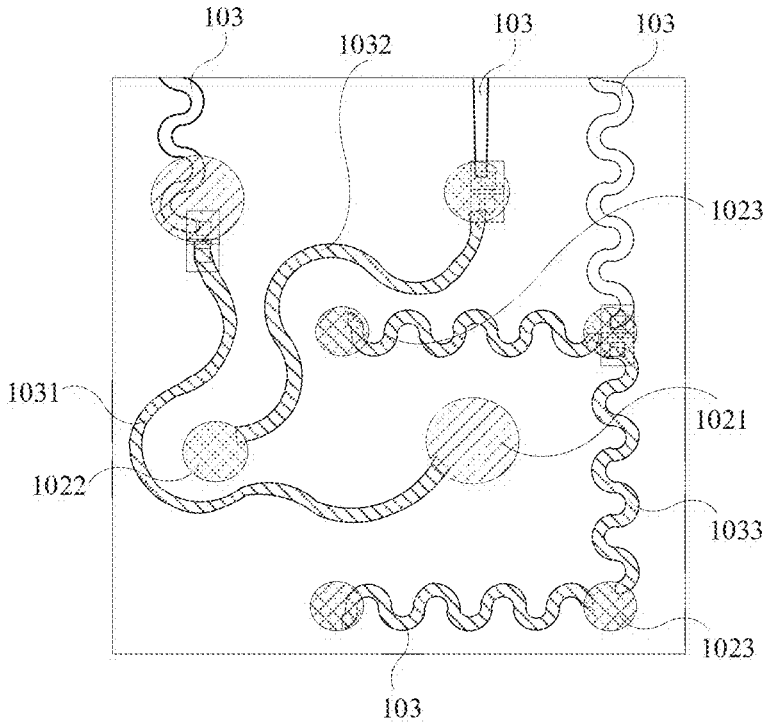

FIG. 3A to FIG. 3B are schematic diagrams of electrical connections of a plurality of auxiliary sub-pixels of the embodiment of the present disclosure. Each of the auxiliary pixel drive circuits 100 can correspondingly drive the plurality of auxiliary sub-pixels 102 to emit light. Therefore, the plurality of auxiliary sub-pixels 102 simultaneously driven by a same auxiliary pixel drive circuit 100 can be electrically connected through connection lines 103.

Alternatively, the connection lines 103 may include a first connection line and a second connection line. The first connection line connects the auxiliary pixel drive circuit 100 and at least one of the auxiliary sub-pixels 102. The second connection line connects two auxiliary sub-pixels 102.

Alternatively, the connection lines 103 may adopt a straight line design, a broken line design, or at least part of the connection lines 103 adopt a serpentine line design.

Alternatively, the plurality of auxiliary sub-pixels 102 connected to a same auxiliary pixel drive circuit 100 have a same luminous color. Furthermore, in order to avoid electrical connection between the plurality of auxiliary sub-pixels 102 driven by different auxiliary pixel drive circuits 100, there is no electrical connection between the connection lines 103 of the plurality of auxiliary sub-pixels 102 of different luminous colors. Specifically, referring to FIG. 3A to FIG. 3B, the second connection line includes a first sub-connection line 1031, a second sub-connection line 1032, and a third sub-connection line 1033. The first sub-connection line 1031 connects two of the first auxiliary sub-pixels 1021. The second sub-connection line 1032 connects two of the second auxiliary sub-pixels 1022. The third sub-connection line 1033 connects two of the third auxiliary sub-pixels 1023. The first sub-connection line 1031 passes round the second auxiliary sub-pixels 1022 and the third auxiliary sub-pixels 1023. The second sub-connection line 1032 passes round the first auxiliary sub-pixels 1021 and the third auxiliary sub-pixels 1023. The third sub-connection line 1033 passes round the first auxiliary sub-pixels 1021 and the second auxiliary sub-pixels 1022. Alternatively, the first sub-connection line 1031, the second sub-connection line 1032, and the third sub-connection line 1033 may be arranged on a same layer or different layers.

It is understandable that in FIG. 3A to FIG. 3B, only the electrical connection manner of the plurality of auxiliary sub-pixels disposed in two composite pixel rows is taken as an example for description. On this basis, another electrical connection of the plurality of auxiliary sub-pixels disposed in three composite pixel rows or four composite pixel rows, etc. can also be obtained, which will not be repeated here.

Figure 4A:
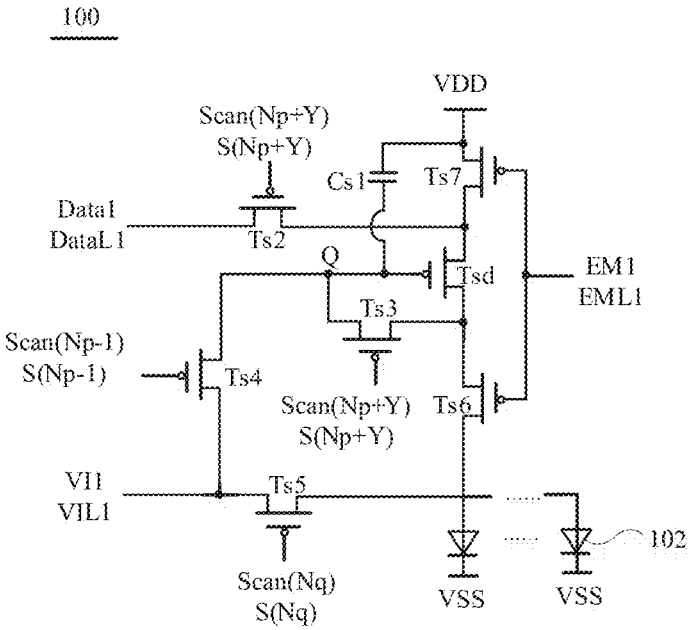
FIG. 4A, FIG. 4B and FIG. 4C are schematic diagrams of auxiliary pixel drive circuits of embodiments of the present disclosure.
Figure 4B:
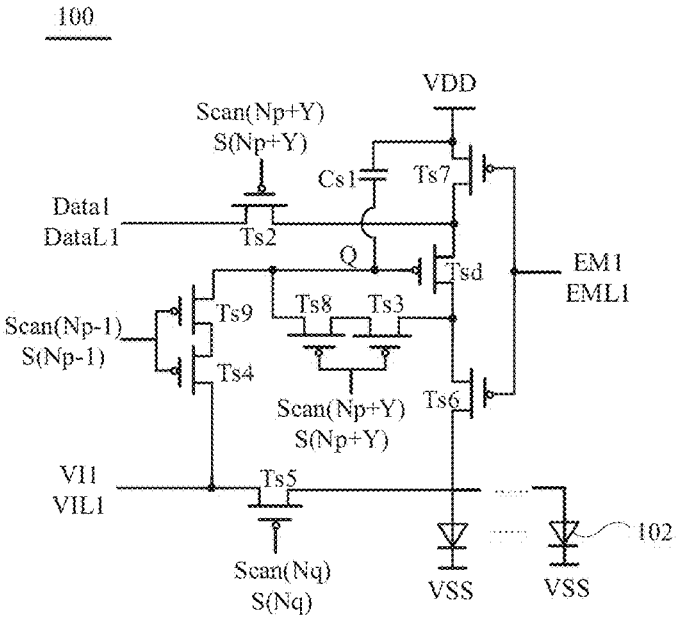
Figure 4C:
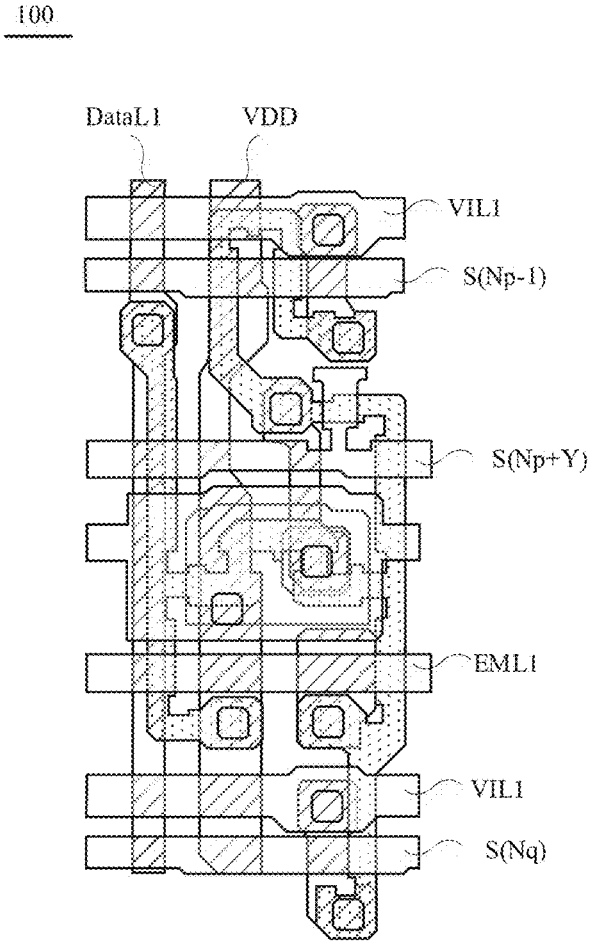
Figure 4D:
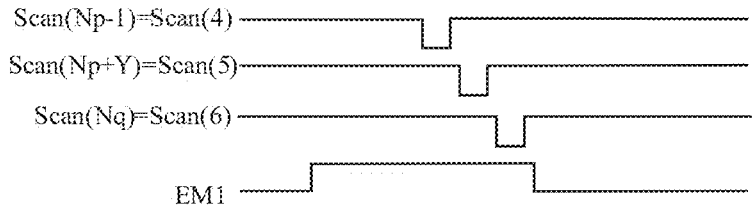
FIG. 4D, FIG. 4E, FIG. 4F and FIG. 4G are working sequence diagrams of the auxiliary pixel drive circuits of the embodiment of the present disclosure.
Figure 4E:
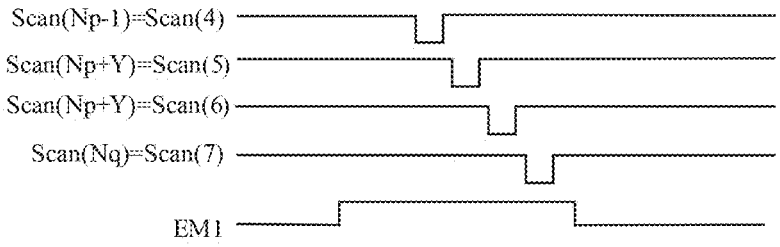
Figure 5A:
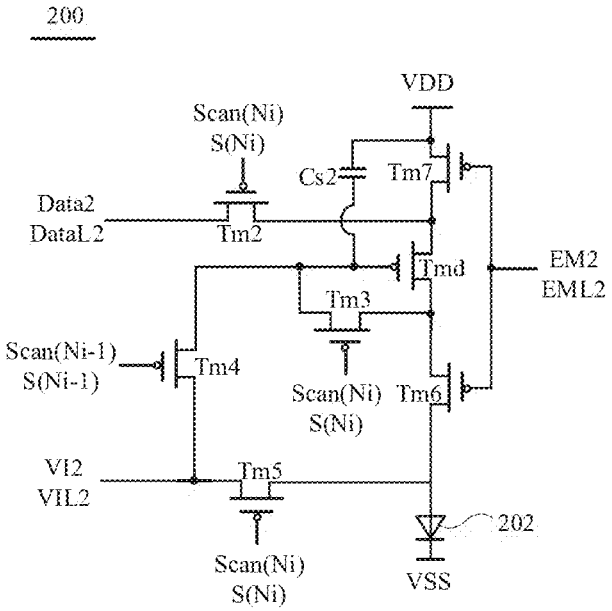
FIG. 5A.
Figure 5B:
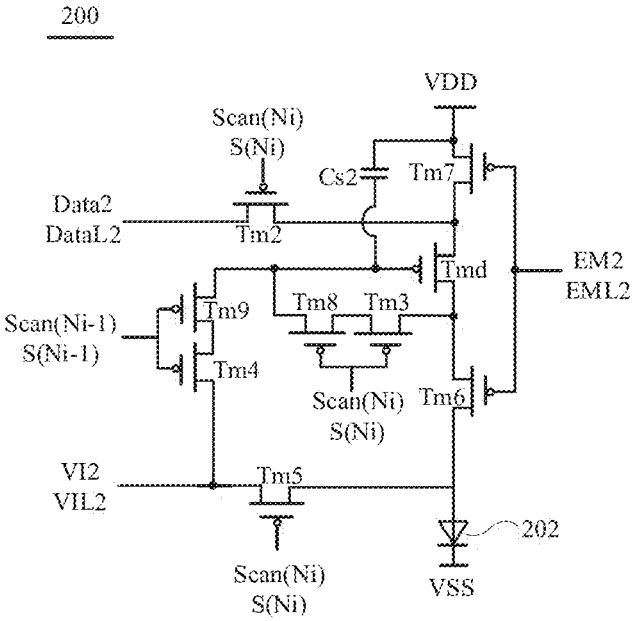
FIG. 5B and FIG. 5C are schematic diagrams of main pixel drive circuits of embodiments of the present disclosure.
Figure 5C:
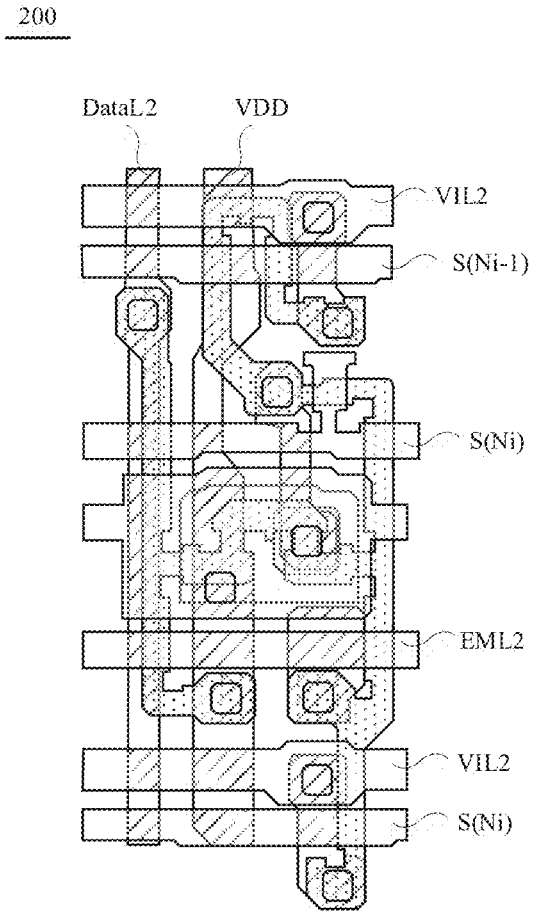
Figure 5D:
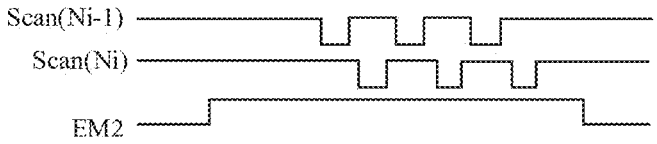
FIG. 5D to FIG. 5E are working sequence diagrams of the main pixel drive circuits of the embodiment of the present disclosure.
Figure 5E:
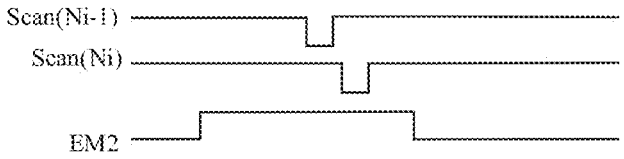
Figure 6A:
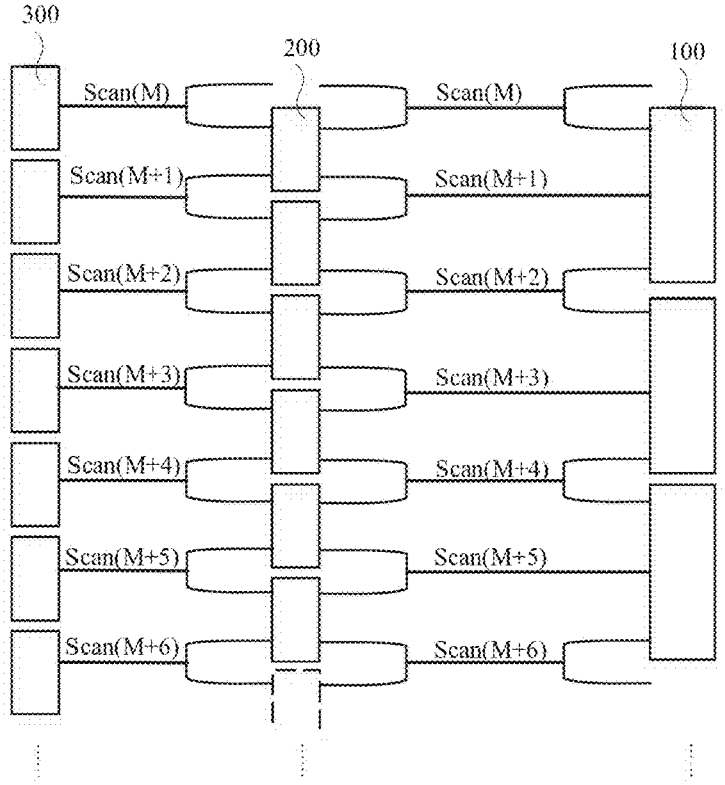
FIG. 6A, FIG. 6B and FIG. 6C are schematic diagrams showing connections of gate drive circuits and the main pixel drive circuits and the auxiliary pixel drive circuits of embodiments of the present disclosure.
Figure 6B:
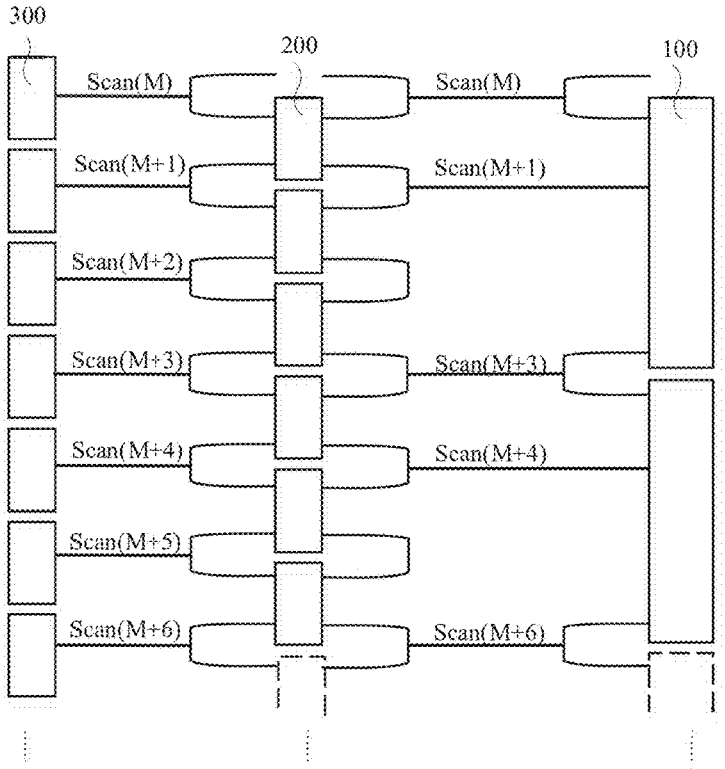
Figure 6C:
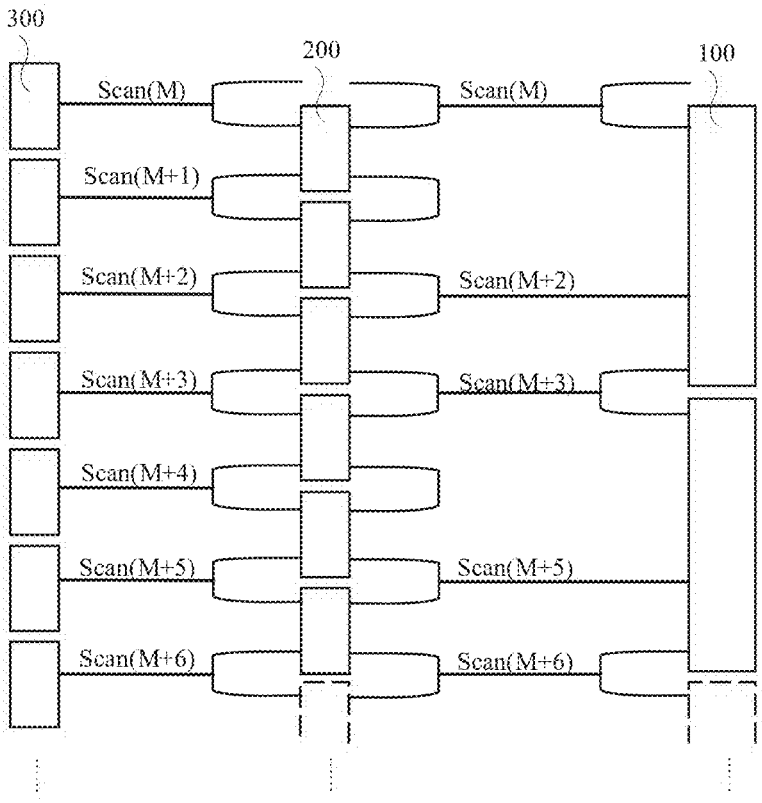

FIG. 4A to FIG. 4C are schematic diagrams of auxiliary pixel drive circuits of embodiments of the present disclosure. FIG. 4D to FIG. 4G are working sequence diagrams of the auxiliary pixel drive circuits of the embodiment of the present disclosure. FIG. 5A to FIG. 5C are schematic diagrams of main pixel drive circuits of embodiments of the present disclosure. FIG. 5D to FIG. 5E are working sequence diagrams of the main pixel drive circuits of the embodiment of the present disclosure. FIG. 6A to FIG. 6C are schematic diagrams showing connections of gate drive circuits and the main pixel drive circuits and the auxiliary pixel drive circuits of embodiments of the present disclosure.

Please refer to FIG. 2A to FIG. 2B, FIG. 4A to FIG. 4C, FIG. 5A to FIG. 5C and FIG. 6A to FIG. 6C. Each of the main pixel drive circuits 200 is connected to X1 of the gate drive circuits 300. Each of the auxiliary pixel drive circuits 100 is connected to X2 of the gate drive circuits 300. $X1 \neq X2$, and $X2 > X1$. X2 of the gate drive circuits 300 provide a plurality of stages of the scanning signals to each auxiliary pixel drive circuit 100. X1 of the gate drive circuits 300 provide a plurality of stages of scanning signals to each of the main pixel drive circuits 200. Therefore, the scanning signals of the auxiliary pixel drive circuit 100 and the main pixel drive circuit 200 corresponding to the auxiliary sub-pixel 102 and the main sub-pixel 202 arranged on a same composite pixel row 101 are different. The problem of the display mismatch between the main display area 100*b* and the functional additional area 100*a* is improved.

Furthermore, $X1 \geq 2$, and $X2 \geq 3$. That is, at least three of the gate drive circuits 300 provide a plurality of stages of scanning signals to each of the auxiliary pixel drive circuits 200. At least two of the gate drive circuits 300 provide a plurality of stages of scanning signals to each of the main pixel drive circuits 200. Therefore, a number of the scanning signals used by each of the auxiliary pixel drive circuits 100 is different from a number of the scanning signals used by the main pixel drive circuit 200 corresponding to each of the main sub-pixels 202 in a same composite pixel row 101 as the plurality of auxiliary sub-pixels 102 connected to the auxiliary pixel drive circuit 100.

Furthermore, the number of the scanning signals used by each of the auxiliary pixel drive circuits 100 is greater than the number of the scanning signals used by the main pixel drive circuit 200 corresponding to each of the main sub-pixels 202 in a same composite pixel row 101 as the plurality of auxiliary sub-pixels 102 connected to the auxiliary pixel drive circuit 100. Specifically, the number of the scanning signals used by each of the auxiliary pixel drive circuits 100 is x2. The number of the scanning signals used by the main pixel drive circuit 200 corresponding to each of the main sub-pixels 202 in a same composite pixel row 101 as the plurality of auxiliary sub-pixels 102 connected to the auxiliary pixel drive circuit 100 is x1, where $x1 < x2$. Furthermore, $x1 \geq 2$, and $x2 \geq 3$.

Alternatively, each of the auxiliary pixel drive circuits 100 and X2 of the gate drive circuits 300 are connected by X22 of the scanning signal lines to transmit x2 of the scanning signals to the auxiliary pixel drive circuits 100. Each of the main pixel drive circuits 200 and X1 of the gate drive circuits 300 are connected by X11 of the scanning signal lines to transmit x1 of the scanning signal to the main pixel drive circuits 200. X11 can be equal to or different from X22. Furthermore, $X11 = X22 = 3$.

According to different positions of the main pixel rows 201 and the composite pixel rows 101, the gate drive circuits 300 correspondingly provide different scanning signals to the plurality of main pixel drive circuits 200 which drive the plurality of main sub-pixels 202 disposed in the main pixel rows 201 to emit light, the main pixel drive circuit 200 which drives the plurality of main sub-pixels 202 disposed in the composite pixel rows 101 to emit light, and the auxiliary pixel drive circuit 100 which drives the plurality of auxiliary sub-pixels 102 disposed in the composite pixel rows 101 to emit light. Thus, for the convenience of description, a working principle of the display panel is explained by taking the plurality of composite pixel rows 101 arranged behind a M-th main pixel row of the plurality of main pixel rows 201 as an example. That is, a first pixel row to the M-th pixel row are the main pixel rows 201, and a (M+1)th pixel row is a first composite pixel row. The plurality of composite pixel rows 101 are arranged behind a last main pixel row of the plurality of main pixel rows 201. Alternatively, a working principle of the display panel of the plurality of composite pixel rows 101 arranged in front of the first main pixel row or a certain main pixel row of the plurality of main pixel rows 201 can be obtained by referring to the working principle of the display panel of the plurality of composite pixel rows 101 arranged behind the M-th main pixel row of the plurality of main pixel rows 201, which will not be repeated here.

Please refer to FIG. 2A to FIG. 2B, FIG. 4A to FIG. 4G, FIG. 5A to FIG. 5C, and FIG. 6A to FIG. 6C. A smallest stage scanning signal line of the plurality of scanning signal lines connected to the auxiliary pixel drive circuit 100 connected to the plurality of auxiliary sub-pixels 102 in a p-th composite pixel row to a q-th composite pixel row is connected to one of the main pixel drive circuits corresponding to the main sub-pixel in the p-th composite pixel row. A largest stage scanning signal line of the plurality of scanning signal lines connected to the auxiliary pixel drive circuit connected to the plurality of auxiliary sub-pixels in the p-th composite pixel row to the q-th composite pixel row is connected to one of the main pixel drive circuits corresponding to the main sub-pixel in the q-th composite pixel row, where p≥1, and q>p.

Specifically, if one of the auxiliary pixel drive circuits 100 is connected to the plurality of auxiliary sub-pixels 102 arranged in the p-th composite pixel row to the q-th composite pixel row, the auxiliary pixel drive circuit 100 connected to the plurality of auxiliary sub-pixels 102 arranged in the p-th composite pixel row 101 to the q-th composite pixel row 101 is connected to X2 of the gate drive circuits 300 through X22 of the scanning signal lines, so as to transmit x2 of the scanning signals to the auxiliary pixel drive circuit 200. In X22 of the scanning signal lines configured to transmit x2 of the scanning signals, the scanning signal line for transmitting the smallest stage scan signal is not only connected to the auxiliary pixel drive circuit 100, but also connected to the main pixel drive circuit 200 corresponding to the main sub-pixel 202 in the p-th composite pixel row. In X22 of the scanning signal lines configured to transmit x2 of the scanning signals, the scanning signal line for transmitting the largest stage scan signal is not only connected to the auxiliary pixel drive circuit 100, but also connected to the main pixel drive circuit 200 corresponding to the main sub-pixel 202 in the q-th composite pixel row.

For example, if one of the auxiliary pixel drive circuits 100 is connected to the plurality of auxiliary sub-pixels 102 disposed in the first composite pixel row to second composite pixel row (i.e., p=1, q=2), the auxiliary pixel drive circuit 100 connected to the plurality of auxiliary sub-pixels 102 in the first composite pixel row to the second composite pixel row is connected to X2 of the gate drive circuits 300 through X22 of the scanning signal lines. In X22 of the scanning signal lines, the scanning signal line for transmitting the smallest stage scan signal is not only connected to the auxiliary pixel drive circuit 100, but also connected to the main pixel drive circuit 200 corresponding to the main sub-pixel 202 in the first composite pixel row. In X22 of the scanning signal lines, the scanning signal line for transmitting the largest stage scan signal is not only connected to the auxiliary pixel drive circuit 100, but also connected to the main pixel drive circuit 200 corresponding to the main sub-pixel 202 in the second composite pixel row.

Similarly, if one of the auxiliary pixel drive circuits 100 is connected to the plurality of auxiliary sub-pixels 102 disposed in the first composite pixel row to a third composite pixel row (i.e., p=1, q=3), the auxiliary pixel drive circuit 100 connected to the plurality of auxiliary sub-pixels 102 in the first composite pixel row to the third composite pixel row is connected to X2 of gate drive circuits 300 through X22 of scanning signal lines. In X22 of the scanning signal lines, the scanning signal line for transmitting the smallest stage scan signal is not only connected to the auxiliary pixel drive circuit 100, but also connected to the main pixel drive circuit 200 corresponding to the main sub-pixel 202 in the first composite pixel row. In X22 of the scanning signal lines, the scanning signal line for transmitting the largest stage scan signal is not only connected to the auxiliary pixel drive circuit 100, but also connected to the main pixel drive circuit 200 corresponding to the main sub-pixel 202 in the third composite pixel row.

Furthermore, if the (M+1)th pixel row is the first composite pixel row of the plurality of composite pixel rows 101, the plurality of auxiliary sub-pixels in the p-th to q-th composite pixel rows 101 are the plurality of auxiliary sub-pixels in an Np-th pixel row to an Nq-th pixel row. It can be seen from the above that the auxiliary pixel drive circuit 100 connected to the plurality of auxiliary sub-pixels 102 disposed in the p-th to q-th composite pixel rows are connected to an (Np−1)th stage scanning signal line S(Np−1), an (Np+Y)th stage scanning signal line S(Np+Y), and an Nq-th stage scanning signal line S(Nq). The main pixel drive circuit 200 corresponding to the main sub-pixel 202 disposed in an i-th composite pixel row is connected to an (Ni−1)th stage scanning signal line S(Ni−1) and an Ni-th stage scanning signal line S(Ni). Np=M+p, Nq=M+q, Ni=M+i. 0≤Y<Nq−Np; p≤i≤q, M≥0.

Specifically, please refer to FIG. 2A to FIG. 2B, FIG. 4A to FIG. 4C, FIG. 5A to FIG. 5C, and FIG. 6A to FIG. 6C. The description will be given by taking an example in which the display panel including N of the pixel rows, where the first pixel row to a fourth pixel row (i.e., M=4) are the main pixel rows 201, and a fifth pixel row to a (m+n)th pixel row are the composite pixel rows. The fifth pixel row is the first composite pixel row 1011 (i.e., if p=1, N1=M+1=5), and a sixth pixel row is the second composite pixel row 1012. By analogy, the (m+n)th pixel row is the last composite pixel row.

The main pixel drive circuit 200 corresponding to the main sub-pixel disposed in a fifth pixel row is the main pixel drive circuit 200 corresponding to the main sub-pixel disposed in the first composite pixel row 1011 (i.e., i=1, N1=M+1=5). The main pixel drive circuit 200 corresponding to the main sub-pixel disposed in the first composite pixel row 1011 is connected to an (N1−1)th stage scanning signal line S(N1−1) and an N1-th stage scanning signal line S(N1). That is, it is connected to a M-th stage scanning signal line S(M) and a (M+1)th stage scanning signal line S(M+1). That is, the main pixel drive circuit 200 corresponding to the main sub-pixel disposed in the first composite pixel row 1011 is connected to a fourth stage scanning signal line S(4) and a fifth stage scanning signal line S(5).

The main pixel drive circuit 200 corresponding to the main sub-pixel disposed in a sixth pixel row is the main pixel drive circuit 200 corresponding to the main sub-pixel disposed in the second composite pixel row 1012 (i.e., i=2, N2=M+2=6). The main pixel drive circuit 200 corresponding to the main sub-pixel disposed in the second composite pixel row 1012 is connected to an (N2−1)th stage scanning signal line S(N2-1) and an N2-th stage scanning signal line S(N2). That is, it is connected to a (M+1)th stage scanning signal line S(M+1) and a (M+2)th stage scanning signal line S(M+2). That is, the main pixel drive circuit 200 corresponding to the main sub-pixel disposed in the second composite pixel row 1012 is connected to a fifth stage scanning signal line S(5) and a sixth stage scanning signal line S(6).

The main pixel drive circuit 200 corresponding to the main sub-pixel disposed in a seventh pixel row is the main pixel drive circuit 200 corresponding to the main sub-pixel disposed in a third composite pixel row 1013 (i.e., i=3, N3=M+3=7). The main pixel drive circuit 200 corresponding to the main sub-pixel disposed in the third composite pixel row 1013 is connected to an (N3-1)th stage scanning signal line S(N3-1) and an N3-th stage scanning signal line S(N3). That is, it is connected to a (M+2)th stage scanning signal line S(M+2) and a (M+3)th stage scanning signal line S(M+3). That is, the main pixel drive circuit 200 corresponding to the main sub-pixel disposed in the third composite pixel row 1013 is connected to a sixth stage scanning signal line S(6) and a seventh stage scanning signal line S(7).

That is, the scanning signal lines connected to the main pixel drive circuit corresponding to the main sub-pixel 102 disposed in the first composite pixel row 1011 are the scanning signal lines S(4) and S(5). The scanning signal lines connected to the main pixel drive circuit corresponding to the main sub-pixel 102 disposed in the second composite pixel row 1012 are the scanning signal lines S(5) and S(6). The scanning signal lines connected to the main pixel drive circuit corresponding to the main sub-pixel 102 disposed in the third composite pixel row 1013 are the scanning signal lines S(6) and S(7).

Based on the above analysis, it can be seen that the main pixel drive circuit 200 corresponding to the main sub-pixel disposed in an Ni-th pixel row is the main pixel drive circuit 200 corresponding to the main sub-pixel disposed in the i-th composite pixel row 101*i* (i.e., Ni=M+i). The main pixel drive circuit 200 corresponding to the main sub-pixel disposed in the i-th composite pixel row 101*i* is connected to the (Ni−1)th stage scanning signal line S(Ni−1) and the Ni-th stage scanning signal line S(Ni).

Each of the auxiliary pixel drive circuits 100 can be connected to the plurality of auxiliary sub-pixels 102 of the plurality of composite pixel rows 101. For ease of understanding, the description will be given by taking an example in which one of the plurality of auxiliary pixel drive circuits 100 is connected to the plurality of auxiliary sub-pixels 102 disposed in two of the composite pixel rows 101 (i.e., q−p+1=2).

Specifically, if one of the plurality of auxiliary pixel drive circuits 100 is connected to the plurality of auxiliary sub-pixels 102 disposed in the first composite pixel row 1011 to the second composite pixel row 1012 (i.e., p=1, q=2) (that is, it is connected to the plurality of auxiliary sub-pixels 102 disposed in the fifth pixel row to the sixth pixel row, namely N1=M+1=5, N2=M+2=6, Y<N2−N1), the auxiliary pixel drive circuit 100 is connected to an (N1-1)th stage scanning signal line, an (N1+Y)th stage scanning signal line, and the N2-th stage scanning signal line. That is, it is connected to the fourth stage scanning signal line S(4), the fifth stage scanning signal line S(5), and the sixth stage scanning signal line S(6).

If one of the plurality of auxiliary pixel drive circuits 100 is connected to the plurality of auxiliary sub-pixels 102 disposed in the third composite pixel row to a fourth composite pixel row (i.e., p=3, q=4) (that is, it is connected to the plurality of auxiliary sub-pixels 102 disposed in the seventh pixel row to an eighth pixel row, namely N3=M+3=7, N4=M+4=8, Y<N4−N3), the auxiliary pixel drive circuit 100 is connected to an (N3−1)th stage scanning signal line, an (N3+Y)th stage scanning signal line, and an N4-th stage scanning signal line. That is, it is connected to the sixth stage scanning signal line S(6), the seventh stage scanning signal line S(7), and an eighth stage scanning signal line S(8).

That is, the scanning signal lines connected to the auxiliary pixel drive circuit connected to the plurality of auxiliary sub-pixels 102 disposed in the first composite pixel row 1011 to the second composite pixel row 1012 (i.e., p=1, q=2) are the scanning signal lines S(4), S(5), and S(6). The scanning signal lines connected to the auxiliary pixel drive circuit connected to the plurality of auxiliary sub-pixels 102 disposed in the third composite pixel row to the fourth composite pixel row (i.e., p=3, q=4) are the scanning signal lines S(6), S(7), and S(8).

Based on the above analysis, it can be seen that if one of the plurality of auxiliary pixel drive circuits 100 is connected to the plurality of auxiliary sub-pixels 102 disposed in the p-th composite pixel row to the q-th composite pixel row (that is, it is connected to the plurality of auxiliary sub-pixels 102 disposed in the Np-th pixel row to the Nq-th pixel row), the auxiliary pixel drive circuit 100 is connected to the (Np−1)th stage scanning signal line, the (Np+Y)th stage scanning signal line, and the Nq-th stage scanning signal line. Np=M+p, Nq=M+q, 0<Y<Nq−Np.

Similarly, the description will be given by taking an example in which one of the plurality of auxiliary pixel drive circuits 100 is connected to the plurality of auxiliary sub-pixels 102 disposed in three of the composite pixel rows 101 (i.e., q−p+1=3).

Specifically, if one of the plurality of auxiliary pixel drive circuits 100 is connected to the plurality of auxiliary sub-pixels 102 disposed in the first composite pixel row 1011 to the third composite pixel row 1013 (i.e., p=1, q=3) (that is, it is connected to the plurality of auxiliary sub-pixels 102 disposed in the fifth pixel row to the seventh pixel row, namely N1=M+1=5, N3=M+3=7, Y<N3−N1, and Y=1 or 0), the auxiliary pixel drive circuit 100 is connected to the (N1−1)th stage scanning signal line, the (N1+Y)th stage scanning signal line, and the N3-th stage scanning signal line. That is, it is connected to the fourth stage scanning signal line S(4), the fifth stage scanning signal line S(5), and the seventh stage scanning signal line S(7). Alternatively, it is connected to the fourth stage scanning signal line S(4), the sixth stage scanning signal line S(6), and the seventh stage scanning signal line S(7).

If one of the plurality of auxiliary pixel drive circuits 100 is connected to the plurality of auxiliary sub-pixels 102 disposed in the fourth composite pixel row to a sixth composite pixel row (i.e., p=4, q=6) (that is, it is connected to the plurality of auxiliary sub-pixels 102 disposed in the eighth pixel row to a tenth pixel row, namely N4=M+4=8, N6=M+6=10, Y<N6-N4, and Y=1 or 0), the auxiliary pixel drive circuit 100 is connected to an (N4-1)th stage scanning signal line, an (N4+Y)th stage scanning signal line, and an N6-th stage scanning signal line. That is, it is connected to the seventh stage scanning signal line S(7), the eighth stage scanning signal line S(8), and a tenth stage scanning signal line S(10). Alternatively, it is connected to the seventh stage scanning signal line S(7), a ninth stage scanning signal line S(9), and the tenth stage scanning signal line S(10).

That is, the scanning signal lines connected to the auxiliary pixel drive circuit connected to the plurality of auxiliary sub-pixels 102 disposed in the first composite pixel row 1011 to the third composite pixel row 1013 (i.e., p=1, q=3) are the scanning signal lines S(4), S(5), and S(7), or the scanning signal lines S(4), S(6), and S(7). The scanning signal lines connected to the auxiliary pixel drive circuit connected to the plurality of auxiliary sub-pixels 102 disposed in the fourth composite pixel row to the sixth composite pixel row (i.e., p=4, q=6) are the scanning signal lines S(7), S(8), and S(10), or the scanning signal lines S(7), S(9), and S(10).

Based on the above analysis, it can be seen that if one of the plurality of auxiliary pixel drive circuits 100 is connected to the plurality of auxiliary sub-pixels 102 disposed in the p-th composite pixel row to the q-th composite pixel row (that is, it is connected to the plurality of auxiliary sub-pixels 102 disposed in the Np-th pixel row to the Nq-th pixel row), the auxiliary pixel drive circuit 100 is connected to the (Np−1)th stage scanning signal line, the (Np+Y)th stage scanning signal line, and the Nq-th stage scanning signal line. Np=M+p, Nq=M+q, 0<Y<Nq-Np.

Similarly, it is also possible to obtain an embodiment in which one of the plurality of auxiliary pixel drive circuits 100 is connected to the plurality of auxiliary sub-pixels 102 disposed in the plurality of composite pixel rows 101 (such as, q−p+1≥4), which will not be repeated here.

Please refer to FIG. 4A to FIG. 4C, the description will be given by taking an example in which the (M+1)th pixel row is the first composite pixel row of the plurality of composite pixel rows. The auxiliary pixel drive circuit connected to the plurality of auxiliary sub-pixels disposed in the p-th to the q-th composite pixel rows include a first drive module, a first initialization module, a first data write module, a first reset module, and a first compensation module.

The first drive module includes an auxiliary drive transistor Tsd.

The first initialization module is connected between a first reset voltage terminal VIL1 and a gate of the auxiliary drive transistor Tsd, and configured to transmit a first reset signal VI1 to the gate of the auxiliary drive transistor Tsd according to an (Np−1)th stage scanning signal Scan(Np−1) to initialize a gate voltage of the auxiliary drive transistor Tsd.

The first data write module is connected between a first data signal line DataL1 and one of a source or a drain of the auxiliary drive transistor Tsd, and is configured to transmit the first data signal Data1 to one of the source or the drain of the auxiliary drive transistor Tsd according to an (Np+Y)th stage scanning signal Scan(Np+Y).

The first reset module is connected between the first reset voltage terminal VIL1 and corresponding anodes of the plurality of auxiliary sub-pixels 102, and is configured to transmit the first reset signal VI1 to the anodes of the plurality of auxiliary sub-pixels 102 according to the Nq-th stage scanning signal Scan(Nq) to reset anode voltages of the plurality of auxiliary sub-pixels 102.

The first compensation module is connected between the gate of the auxiliary drive transistor Tsd and one of the source or the drain of the auxiliary drive transistor Tsd, and is configured to transmit the first data signal Data1 to the gate of the auxiliary drive transistor Tsd according to the (Np+Y)th stage scanning signal Scan(Np+Y) to compensate a threshold voltage of the auxiliary drive transistor Tsd.

Np=M+p, and Nq=M+q. 0≤Y<Nq−Np, M≥0, p≥1, and q>p.

Furthermore, the auxiliary pixel drive circuit 100 also includes a first storage module and a first light-emitting control module. The first storage module is connected in series between the gate of the auxiliary drive transistor Tsd and a first voltage terminal VDD, and is configured to maintain the gate voltage of the auxiliary drive transistor Tsd. The first light-emitting control module is connected in series with the auxiliary drive transistor Tsd, and is configured to control the corresponding plurality of auxiliary sub-pixels 102 to emit light according to a first light-emitting control signal EM1.

A cathode of each auxiliary sub-pixel 102 is connected to a second voltage terminal VSS.

Alternatively, each of the auxiliary pixel drive circuits 100 and each of the main pixel drive circuits 200 have a same circuit topology. That is, each of the auxiliary pixel drive circuits 100 and each of the main pixel drive circuits 200 have a same circuit connection structure, and/or a same wiring method. Without changing a process difficulty and the circuit topology, the problem of the display mismatch between the main display area 100*b* and the functional additional area 100*a* is improved. The same wiring method includes a layout and a wiring shape of each film layer when the auxiliary pixel drive circuits 100 and the main pixel drive circuits 200 are formed during a manufacturing process of the display panel.

Specifically, please refer to FIG. 5A to FIG. 5C. The main pixel drive circuit connected to one of the main sub-pixels disposed in the Ni-th pixel row includes a second drive module, a second initialization module, a second data write module, a second reset module, and a second compensation module.

The second drive module includes a main drive transistor Tmd.

The second initialization module is connected between a second reset voltage terminal VIL2 and a gate of the main drive transistor Tmd, and is configured to transmit a second reset signal VI2 to the gate of the main drive transistor Tmd according to an (Ni−1)th stage scanning signal Scan(Ni−1) to initialize a gate voltage of the main drive transistor Tmd.

The second data write module is connected between a second data signal line DataL2 and one of a source or a drain of the main drive transistor Tmd, and is configured to transmit a second data signal Data2 to one of the source or the drain of the main drive transistor Tmd according to the (Ni−1)th stage scanning signal Scan(Ni).

The second reset module is connected between the second reset voltage terminal VIL2 and a corresponding anode of the main sub-pixel 202, and is configured to transmit the second reset signal VI2 to the corresponding anode of the main sub-pixel 202 according to the (Ni−1)th stage scanning signal Scan(Ni) to reset an anode voltage of the main sub-pixel 202.

The second compensation module is connected between the gate of the main drive transistor Tmd and one of the source or the drain of the main drive transistor Tmd, and is configured to transmit the second data signal Data2 to the gate of the main drive transistor Tmd according to the (Ni−1)th stage scanning signal Scan(Ni) to compensate a threshold voltage of the main drive transistor Tmd, where Ni≥1, and i≥1.

Furthermore, the main pixel drive circuit 200 also includes a second storage module and a second light-emitting control module. The second storage module is connected in series between the gate of the main drive transistor Tmd and the first voltage terminal VDD to maintain the gate voltage of the main drive transistor Tmd. The second light-emitting control module is connected in series with the main drive transistor Tmd, and is configured to control the corresponding main sub-pixel 202 to emit light according to a second light-emitting control signal EM2.

A cathode of each of the main sub-pixels 202 is connected to the second voltage terminal VSS.

Please refer to FIG. 2A to FIG. 2B, FIG. 4A to FIG. 4C, and FIG. 5A to FIG. 5C, the description will be given by taking an example in which the first pixel row to fourth pixel row (i.e., M=4) are the main pixel rows 201, and the fifth pixel row to the (m+n)th pixel row are the composite pixel rows. The fifth pixel row is the first composite pixel row 1011 (i.e., if p=1, N1=M+1=5), and the sixth pixel row is the second composite pixel row 1012. By analogy, the (m+n)th pixel row is the last composite pixel row.

For ease of understanding, the description will be given by taking an example in which one of the plurality of auxiliary pixel drive circuits 100 is connected to the plurality of auxiliary sub-pixels 102 disposed in two of the composite pixel rows 101 (i.e., q−p+1=2).

Specifically, if one of the plurality of auxiliary pixel drive circuits 100 is connected to the plurality of auxiliary sub-pixels 102 disposed in the first composite pixel row 1011 to the second composite pixel row 1012 (i.e., p=1, q=2, corresponding to the fifth pixel row to the sixth pixel row, N1=M+1=5, N2=M+2=6), N1=5 and N2=6, and thus Y=0.

Therefore, the first initialization module of the auxiliary pixel drive circuit 100 is configured to transmit the first reset signal VI1 to the gate of the auxiliary drive transistor Tsd according to an (N1−1)th stage scanning signal (i.e., a fourth stage scanning signal Scan(4)) to initialize the gate voltage of the auxiliary drive transistor Tsd. The first data write module is configured to transmit the first data signal Data1 to one of the source or the drain of the auxiliary drive transistor Tsd according to an N1-th stage scanning signal (i.e., a fifth stage scanning signal Scan(5)). The first reset module is configured to transmit the first reset signal VI1 to the corresponding anodes of the plurality of auxiliary sub-pixels 102 according to an N2-th stage scanning signal (i.e., a sixth stage scanning signal Scan(6)) to reset the anode voltages of the plurality of auxiliary sub-pixels 102. The first compensation module is configured to transmit the first data signal Data1 to the gate of the auxiliary drive transistor Tsd according to the N1-th stage scanning signal (i.e., the fifth stage scanning signal Scan(5)) to compensate the threshold voltage of the auxiliary drive transistor Tsd.

The second initialization module of the main pixel drive circuit 200 corresponding to the main sub-pixel 102 disposed in the first composite pixel row 1011 (i.e., i=1, N1=5) is configured to transmit the second reset signal VI2 to the gate of the main drive transistor Tmd according to the (N1-1)th stage scanning signal (i.e., the fourth stage scanning signal Scan(4)) to initialize the gate voltage of the main drive transistor Tmd. The second data write module is configured to transmit the second data signal Data2 to one of the source or the drain of the main drive transistor Tmd according to the N1-th stage scanning signal (i.e. the fifth stage scanning signal Scan(5)). The second reset module is configured to transmit the second reset signal VI2 to the anode of the corresponding main sub-pixel 202 according to the N1-th stage scanning signal (i.e. the fifth stage scanning signal Scan(5)) to reset the anode voltage of the main sub-pixel 202. The second compensation module is configured to transmit the second data signal Data2 to the gate of the main drive transistor Tmd according to the N1-th stage scanning signal (i.e., the fifth stage scanning signal Scan(5)) to compensate the threshold voltage of the main drive transistor Tmd.

The second initialization module of the main pixel drive circuit 200 corresponding to the main sub-pixel 102 disposed in the second composite pixel row 1011 (i.e., i=2, N2=6) is configured to transmit the second reset signal VI2 to the gate of the main drive transistor Tmd according to an (N2−1)th stage scanning signal (i.e., the fifth stage scanning signal Scan(5)) to initialize the gate voltage of the main drive transistor Tmd. The second data write module is configured to transmit the second data signal Data2 to one of the source or the drain of the main drive transistor Tmd according to the N2-th stage scanning signal (i.e. the sixth stage scanning signal Scan(6)). The second reset module is configured to transmit the second reset signal VI2 to the anode of the corresponding main sub-pixel 202 according to the N2-th stage scanning signal (i.e. the sixth stage scanning signal Scan(6)) to reset the anode voltage of the main sub-pixel 202. The second compensation module is configured to transmit the second data signal Data2 to the gate of the main drive transistor Tmd according to the N2-th stage scanning signal (i.e., the sixth stage scanning signal Scan(6)) to compensate the threshold voltage of the main drive transistor Tmd.

That is, the scanning signals used by the auxiliary pixel drive circuit connected to the plurality of auxiliary sub-pixels 102 disposed in the first composite pixel row 1011 to the second composite pixel row 1012 (i.e., p=1, q=2) are the scanning signals Scan(4), Scan(5), and Scan(6). The scanning signals used by the main pixel drive circuit connected to one main sub-pixel 102 in the first composite pixel row 1011 are the scanning signals Scan(4) and Scan(5). The scanning signals used by the main pixel drive circuit connected to one main sub-pixel 102 disposed in the second composite pixel row 1012 are the scanning signals Scan(5) and Scan(6).

Similarly, it is also possible to obtain not only the embodiment in the first composite pixel row 1011 to the second composite pixel row 1012, but also an embodiment in which one of the plurality of auxiliary pixel drive circuits 100 is connected to the plurality of auxiliary sub-pixels 102 disposed in two of the composite pixel rows 101 (i.e., q−p+1=2), and the main pixel drive circuit 200 is connected to the corresponding main sub-pixel 202, which will not be repeated here.

The description will be given by taking an example in which one of the plurality of auxiliary pixel drive circuits 100 is connected to the plurality of auxiliary sub-pixels 102 disposed in three of the composite pixel rows 101 (i.e., q−p+1=3).

Specifically, if one of the plurality of auxiliary pixel drive circuits 100 is connected to the plurality of auxiliary sub-pixels 102 disposed in the first composite pixel row 1011 to the third composite pixel row 1013 (i.e., p=1, q=3) (that is, it is connected to the plurality of auxiliary sub-pixels 102 disposed in the fifth pixel row to the seventh pixel row, namely N1=M+1=5, N3=M+3=7), N1=5 and N3=7. It can be obtained by $0 \leq Y < N3-N1$, Y=1 or Y=0. Therefore, the first initialization module of the auxiliary pixel drive circuit 100 is configured to transmit the first reset signal VI1 to the gate of the auxiliary drive transistor Tsd according to the (N1−1)th stage scanning signal (i.e., the fourth stage scanning signal Scan(4)) to initialize the gate voltage of the auxiliary drive transistor Tsd. The first data write module is configured to transmit the first data signal Data1 to one of the source or the drain of the auxiliary drive transistor Tsd according to an (N1+Y)th stage scanning signal (i.e. the fifth stage scanning signal Scan(5) or the sixth stage scanning signal Scan(6)). The first reset module is configured to transmit the first reset signal VI1 to the anodes of the plurality of auxiliary sub-pixels 102 according to the third stage scanning signal (i.e., the seventh stage scanning signal Scan(7)) to reset the anode voltages of the plurality of auxiliary sub-pixels 102. The first compensation module is configured to transmit the first data signal Data1 to the gate of the auxiliary drive transistor Tsd according to the (N1+Y)th stage scanning signal (i.e., the fifth stage scanning signal Scan(5) or the sixth stage scanning signal Scan(6)) to compensates the threshold voltage of the auxiliary drive transistor Tsd.

Based on the aforementioned analysis in which the main pixel drive circuit 200 corresponding to the main sub-pixel 102 disposed in the first composite pixel row 1011 (i.e., i=1, N1=5) and the main pixel drive circuit 200 corresponding to the main sub-pixel 102 disposed in the second composite pixel row 1012 (i.e., i=2, N2=6), for the main pixel drive circuit 200 corresponding to the main sub-pixel 102 disposed in the third composite pixel row 1013 (i.e., i=3, N3=7), the second initialization module is configured to transmit the second reset signal VI2 to the gate of the main drive transistor Tmd according to an (N3−1) stage scanning signal (i.e., the sixth stage scanning signal Scan(6)) to initialize the gate voltage of the main drive transistor Tmd. The second data write module is configured to transmit the second data signal Data2 to one of the source or the drain of the main drive transistor Tmd according to the third stage scanning signal (i.e., the seventh stage scanning signal Scan(7)). The second reset module is configured to transmit the second reset signal VI2 to the anode of the corresponding main sub-pixel 202 according to the third stage scanning signal (i.e., the seventh stage scanning signal Scan(7)) to reset the threshold voltage of the main drive transistor Tmd. The second compensation module is configured to transmit the second data signal Data2 to the gate of the main drive transistor Tmd according to the third stage scanning signal (i.e., the seventh stage scanning signal Scan(7)) to compensate the threshold voltage of the main drive transistor Tmd.

That is, the scanning signals used by the auxiliary pixel drive circuit connected to the plurality of auxiliary sub-pixels 102 disposed in the first composite pixel row 1011 to the third composite pixel row 1013 (i.e., p=1, q=3) are the scanning signals Scan(4), Scan(5), and Scan(7), or the scanning signals Scan(4), Scan(6), and Scan(7). The scanning signals used by the main pixel drive circuit connected to one main sub-pixel 102 disposed in the first composite pixel row 1011 are the scanning signals Scan(4) and Scan(5). The scanning signals used by the main pixel drive circuit connected to one main sub-pixel 102 disposed in the second composite pixel row 1012 are the scanning signals Scan(5) and Scan(6). The scanning signals used by the main pixel drive circuit connected to one main sub-pixel 102 disposed in the third composite pixel row 1013 are the scanning signals Scan(6) and Scan(7).

Similarly, it is also possible to obtain not only the embodiment in the first composite pixel row 1011 to the third composite pixel row 1013, but also an embodiment in which one of the plurality of auxiliary pixel drive circuits 100 is connected to the plurality of auxiliary sub-pixels 102 disposed in three of the composite pixel rows 101 (i.e., q−p+1=3), which will not be repeated here.

Similarly, it is also possible to obtain an embodiment in which one of the plurality of auxiliary pixel drive circuits 100 is connected to the plurality of auxiliary sub-pixels 102 disposed in three of the plurality of composite pixel rows 101 (e.g., q−p+1≥4), and the main pixel drive circuit 200 is connected to the corresponding main sub-pixel 202, which will not be repeated here.

From the above analysis, it can be seen that the plurality of auxiliary sub-pixels 102 and the plurality of main sub-pixels 202 disposed in different composite pixel rows 101 can be matched with the corresponding scanning signals according to information of the composite pixel rows 101 where they are disposed. It solves the problem of mismatch between luminescences of the auxiliary sub-pixels 102 and the main sub-pixels 101 since the auxiliary pixel drive circuit 100 drive the plurality of auxiliary sub-pixels 102 disposed in the different composite pixel rows 101 to emit light, and the main sub-pixels 202 disposed in the same composite pixel row 101 as the plurality of auxiliary sub-pixels 102 are driven to emit light by the corresponding main sub-pixels. A display performance of the display panel is ensured.

Referring to FIG. 4A to FIG. 4C, the first data write module includes a first data transistor Ts2. A gate of the first data transistor Ts2 is connected to the (Np+Y)th stage scanning signal line S(Np+Y). One of a source or a drain of the first data transistor Ts2 is connected to the first data line DataL1. The other of the source or the drain of the first data transistor Ts2 is connected to one of the source or the drain of the auxiliary drive transistor Tsd. The (Np+Y)th stage scanning signal Scan(Np+Y) inputs to the (Np+Y)th stage scanning signal line S(Np+Y).

The first reset module includes a first reset transistor Ts5. A gate of the first reset transistor Ts5 is connected to the Nq-th stage scanning signal line S(Nq). One of a source or a drain of the first reset transistor Ts5 is connected to the first reset voltage terminal VIL1. The other of the source or the drain of the first reset transistor Ts5 is connected to the anodes of the corresponding plurality of auxiliary sub-pixels 102. The Nq-th stage scanning signal Scan(Nq) inputs to the Nq-th stage scanning signal line S(Nq).

The first storage module includes a first storage capacitor Cs1. The first storage capacitor Cs1 is connected in series between the first voltage terminal VDD and the gate of the auxiliary drive transistor Tsd.

The first light-emitting control module includes a first switch transistor Ts6 and a second switch transistor Ts7. A gate of the first switch transistor Ts6 is connected to a first light-emitting signal control line EML1. One of a source or a drain of the first switch transistor Ts6 is connected to the other of the source or the drain of the auxiliary drive transistor Tsd. The other of the source or the drain of the first switch transistor Ts6 is connected to the anodes of the corresponding plurality of auxiliary sub-pixels 102. A gate of the second switch transistor Ts7 is connected to the first light-emitting signal control line EML1. One of a source or a drain of the second switch transistor Ts7 is connected to the first voltage terminal VDD. The other of the source or the drain of the second switch transistor Ts7 is connected to one of the source or the drain of the auxiliary drive transistor Tsd and one of the source or the drain of the first data transistor Ts2. A first light-emitting control signal EM1 inputs to the first light-emitting signal control line EML1.

Please refer to FIG. 4A, the first initialization module includes a first initialization transistor Ts4. A gate of the first initialization transistor Ts4 is connected to the (Np−1)th stage scanning signal line S(Np−1). One of a source or a drain of the first initialization transistor Ts4 is connected to the gate of the auxiliary drive transistor Tsd. The other of the source or the drain of the first initialization transistor Ts4 is connected to the first reset voltage terminal VIL1. The (Np−1)th stage scanning signal Scan(Np−1) inputs to the (Np−1)th stage scanning signal line S(Np−1), and the first reset signal VI1 inputs to the first reset voltage terminal VIL1.

The first compensation module includes a first compensation transistor Ts3. A gate of the first compensation transistor Ts3 is connected to the (Np+Y)th stage scanning signal line S(Np+Y). One of a source or a drain of the first compensation transistor Ts3 is electrically connected to the gate of the auxiliary drive transistor Tsd. The other of the source or the drain of the first compensation transistor Ts3 is connected to the other of the source or the drain of the auxiliary drive transistor Tsd and one of the source or the drain of the first switch transistor Ts6.

Alternatively, both the first compensation transistor Ts3 and the first initialization transistor Ts4 can adopt transistors with a double gate structure.

Please refer to FIG. 4B, the first initialization module also includes a second initialization transistor Ts9. The gate of the first initialization transistor Ts4 and a gate of the second initialization transistor Ts9 are both connected to the (Np−1)th stage scanning signal line S(Np−1). One of the source or the drain of the first initialization transistor Ts4 is connected to the first reset voltage terminal VIL1. The other of the source or the drain of the first initialization transistor Ts4 is connected to one of a source or a drain of the second initialization transistor Ts9. The other of the source or the drain of the second initialization transistor Ts9 is connected to the gate of the auxiliary drive transistor Tsd.

The first compensation module also includes a second compensation transistor Ts8. The gate of the first compensation transistor Ts3 and a gate of the second compensation transistor Ts8 are both connected to the (Np+Y)th stage scanning signal line S(Np+Y). One of a source or a drain of the second compensation transistor Ts8 is connected to the gate of the auxiliary drive transistor Tsd. The other of the source or the drain of the second compensation transistor Ts8 is connected to one of the source or the drain of the first compensation transistor Ts3. The other of the source or the drain of the first compensation transistor Ts3 is connected to the other of the source or the drain of the auxiliary drive transistor Tsd.

It can be understood that the transistors in the auxiliary pixel drive circuit 100 include at least one of silicon transistors and oxide transistors. The transistors in the auxiliary pixel drive circuit 100 include at least one of P-type transistors and N-type transistors. The transistors in the auxiliary pixel drive circuit 100 include field effect transistors. Furthermore, the field effect transistors include metal-oxide semiconductor field effect transistors and thin film transistors.

Referring to FIG. 5A to FIG. 5C, the second data write module includes a second data transistor Tm2. A gate of the second data transistor Tm2 is connected to the Ni-th stage scanning signal line S(Ni). One of a source or a drain of the second data transistor Tm2 is connected to the second data line DataL2. The other of the source or the drain of the second data transistor Tm2 is connected to one of the source or the drain of the main drive transistor Tmd.

The second reset module includes a second reset transistor Tm5. A gate of the second reset transistor Tm5 is connected to the Ni-th stage scanning signal line S(Ni). One of a source or a drain of the second reset transistor Tm5 is connected to a second reset voltage terminal VIL2. The other of the source or the drain of the second reset transistor Tm5 is connected to the anode of the corresponding main sub-pixel 202.

The second storage module includes a second storage capacitor Cs2. The second storage capacitor Cs2 is connected in series between the first voltage terminal VDD and the gate of the main drive transistor Tmd.

The second light-emitting control module includes a third switch transistor Tm6 and a fourth switch transistor Tm7. A gate of the third switch transistor Tm6 is connected to a second light-emitting signal control line EML2. One of a source or a drain of the third switch transistor Tm6 is connected to the other of the source or the drain of the main drive transistor Tmd. The other of the source or the drain of the third switch transistor Tm6 is connected to the anode of the corresponding main sub-pixel 102. A gate of the fourth switch transistor Tm7 is connected to the second light-emitting signal control line EML2. One of a source or a drain of the fourth switch transistor Tm7 is connected to the first voltage terminal VDD. The other of the source or the drain of the fourth switch transistor Tm7 is connected to one of the source or the drain of the main drive transistor Tmd and one of the source or the drain of the second data transistor Tm2.

A cathode of each of the main sub-pixels 202 is connected to the second voltage terminal VSS.

Please refer to FIG. 5A, the second initialization module includes a third initialization transistor Tm4. A gate of the third initialization transistor Tm4 is connected to the (Ni−1)th stage scanning signal line S(Ni−1). One of a source or a drain of the third initialization transistor Tm4 is connected to the gate of the main drive transistor Tmd. The other of the source or the drain of the third initialization transistor Tm4 is connected to the second reset voltage terminal VIL2.

The second compensation module includes a third compensation transistor Tm3. A gate of the third compensation transistor Tm3 is connected to the Ni-th stage scanning signal line S(Ni). One of a source or a drain of the third compensation transistor Tm3 is electrically connected to the gate of the main drive transistor Tmd. The other of the source or the drain of the third compensation transistor Tm3 is connected to the other of the source or the drain of the main drive transistor Tmd.

Alternatively, both the third compensation transistor Tm3 and the third initialization transistor Tm4 can be transistors with a double gate structure.

Please refer to FIG. 5B, the second initialization module also includes a fourth initialization transistor Tm9. The gate of the third initialization transistor Tm4 and a gate of the fourth initialization transistor Tm9 are both connected to the (Ni−1)th stage scanning signal line S(Ni−1). One of the source or the drain of the third initialization transistor Tm4 is connected to the second reset voltage terminal VIL2. The other of the source or the drain of the third initialization transistor Tm4 is connected to one of a source or a drain of the fourth initialization transistor Tm9. The other of the source or the drain of the fourth initialization transistor Tm9 is connected to the gate of the main drive transistor Tmd.

The second compensation module also includes a fourth compensation transistor Tm8. The gate of the third compensation transistor Tm3 and a gate of the fourth compensation transistor Tm8 are both connected to the Ni-th stage scanning signal line S(Ni). One of the source or the drain of the third compensation transistor Tm3 is electrically connected to the gate of the main drive transistor Tmd. The other of the source or the drain of the third compensation transistor Tm3 is connected to one of a source or a drain of the fourth compensation transistor Tm8. The other of the source or the drain of the fourth compensation transistor Tm8 is connected to the other of the source or the drain of the main drive transistor Tmd.

Please refer to FIG. 4B, FIG. 4D, FIG. 4F, and FIG. 5B, the description of a working principle of the auxiliary pixel drive circuit will be given by taking an example in which the first pixel row to fourth pixel row (i.e., M=4) are the main pixel rows 201, and the fifth pixel row to the (m+n)th pixel row are the composite pixel rows. The fifth pixel row is the first composite pixel row 1011 (i.e., if p=1, N1=M+1=5). The sixth pixel row is the second composite pixel row 1012. By analogy, the (m+n)th pixel row is the last composite pixel row.

For the convenience of description, the description will be given by taking an example in which the auxiliary pixel drive circuit 100 drives the plurality of auxiliary sub-pixels 102 in the first to the second composite pixel rows 101 (i.e., N1=5, N2=6, Y=0) to emit light, and the transistors in the auxiliary pixel drive circuit 100 are P-type transistors.

When the fourth stage scanning signal Scan(4) is at a low level, the first initialization transistor Ts4 and the second initialization transistor Ts9 are turned on in response to the fourth stage scanning signal Scan(4) loaded by the fourth stage scanning signal line S(4). The first reset signal VI1 loaded by the first reset signal line VIL1 is transmitted to the gate of the auxiliary drive transistor Tsd to initialize the gate voltage of the auxiliary drive transistor Tsd (that is, the first reset signal VI1 is transmitted to a Q point). The third initialization transistor Tm4 and the fourth initialization transistor Tm9 in the main pixel drive circuit 200 corresponding to the main sub-pixel 202 disposed in the first composite pixel row are turned on in response to the fourth stage scanning signal Scan(4) loaded by the fourth stage scanning signal line S(4). The second reset signal VI2 loaded by the second reset signal line VIL2 is transmitted to the gate of the main drive transistor Tmd in the main pixel drive circuit 200 corresponding to the main sub-pixel 202 in the first composite pixel row to initialize the gate voltage of the main drive transistor Tmd.

When the fifth stage scanning signal Scan(5) is at a low level, the first data transistor Ts2, the first compensation transistor Ts3, and the second compensation transistor Ts8 are turned on in response to the fifth stage scanning signal Scan(5) loaded by the fifth stage scanning signal line S(5). The first data signal Data1 having a function of compensating the threshold voltage is transmitted to the gate of the auxiliary drive transistor Tsd. The first storage capacitor Cs1 is charged. The auxiliary drive transistor Tsd is turned on. The first storage capacitor Cs1 holds the gate voltage of the auxiliary drive transistor Tsd. Thus, the compensation of the threshold voltage of the auxiliary drive transistor Tsd is realized. The second data transistor Tm2, the second reset transistor Tm5, the third compensation transistor Tm3, and the fourth compensation transistor Tm8 in the main pixel drive circuit 200 corresponding to the main sub-pixel 202 disposed in the first composite pixel row are turned on in response to the fifth stage scanning signal Scan(5) loaded by the fifth stage scanning signal line S(5). The second data signal Data2 having a function of compensating the threshold voltage is transmitted to the gate of the main drive transistor Tmd of the main pixel drive circuit 200 corresponding to the main sub-pixel 202 disposed in the first composite pixel row. Thus, the compensation of the threshold voltage of the main drive transistor Tmd is realized. The second reset signal VI2 is transmitted to the anode of the corresponding main sub-pixel 202 to reset the anode voltage of the main sub-pixel 202. The third initialization transistor Tm4 and the fourth initialization transistor Tm9 in the main pixel drive circuit 200 corresponding to the main sub-pixel 202 disposed in the second composite pixel row are turned on in response to the fifth stage scanning signal Scan(5) loaded by the fifth stage scanning signal line S(5). The second reset signal VI2 loaded by the second reset signal line VIL2 is transmitted to the gate of the main drive transistor Tmd of the main pixel drive circuit 200 corresponding to the main sub-pixel 202 in the second composite pixel row to initialize the gate voltage of the main drive transistor Tmd.

When the second light-emitting control signal EM2 is at a low level, the third switch transistor Tm6 and the fourth switch transistor Tm7 in the main pixel drive circuit 200 corresponding to the main sub-pixel 202 disposed in the first composite pixel row are turned on in response to the second light-emitting control signal EM2 loaded by a second light-emitting control signal line EML2. The main drive transistor Tmd in the main pixel drive circuit 200 corresponding to the main sub-pixel 202 disposed in the first composite pixel row drives the corresponding main sub-pixel 202 to emit light according to the second data signal Data2.

When the sixth stage scanning signal Scan(6) is at a low level, the first reset transistor Ts5 is turned on in response to the sixth stage scanning signal Scan(6) loaded by the sixth stage scanning signal line S(6). The first reset transistor Ts5 is turned on so that the first reset signal VI1 is transmitted to the anodes of the plurality of auxiliary sub-pixels 102, thereby realizing the initialization of the anode voltages of the plurality of auxiliary sub-pixels 102. The second data transistor Tm2, the second reset transistor Tm5, the third compensation transistor Tm3, and the fourth compensation transistor Tm8 in the main pixel drive circuit 200 corresponding to the main sub-pixel 202 disposed in the second composite pixel row are turned on in response to the sixth stage scanning signal Scan(6) loaded by the sixth stage scanning signal line S(6). The second data signal Data2 with a function of compensating the threshold voltage is transmitted to the gate of the main drive transistor Tmd in the main pixel drive circuit 200 corresponding to the main sub-pixel 202 disposed in the second composite pixel row, thereby realizing the compensation of the threshold voltage of the main drive transistor Tmd. The second reset signal VI2 is transmitted to the anode of the corresponding main sub-pixel 202 to reset the anode voltage of the main sub-pixel 202.

When the first light-emitting control signal EM1 is at a low level, the first switch transistor Ts6 and the second switch transistor Ts7 are turned on in response to the first light-emitting control signal EM1 loaded by the first light-emitting control signal line EML1. The auxiliary drive transistor Tsd drives the plurality of auxiliary sub-pixels 102 to emit light according to the first data signal Data1. When the second light-emitting control signal EM2 is at a low level, the third switch transistor Tm6 and the fourth switch transistor Tm7 in the main pixel drive circuit 200 corresponding to the main sub-pixel 202 disposed in the second composite pixel row are turned on in response to the second light-emitting control signal EM2 loaded by the second light-emitting control signal line EML2. The main drive transistor Tmd in the main pixel drive circuit 200 corresponding to the main sub-pixel 202 disposed in the second composite pixel row drives the corresponding main sub-pixel 202 to emit light according to the second data signal Data2.

Figure 4F:
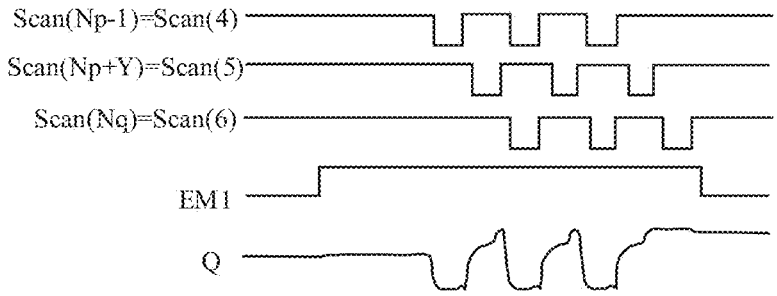
Figure 4G:
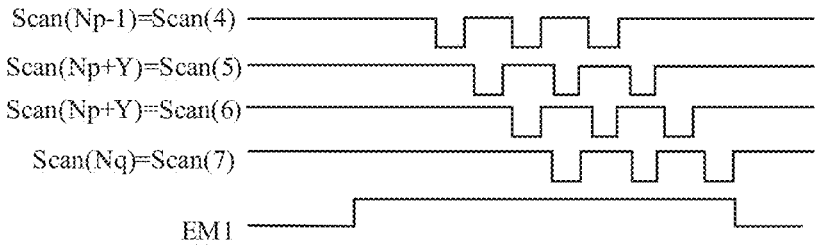

When the auxiliary pixel drive circuit 100 drives the plurality of auxiliary sub-pixels 102 to emit light using the working sequence shown in FIG. 4F, the gate voltage of the auxiliary drive transistor Tsd and the anode voltage of the auxiliary sub-pixel 102 are reset three times. Therefore, a response speed of the auxiliary pixel drive circuit 100 is faster.

Similarly, please refer to FIG. 4B, FIG. 4E, FIG. 4G and FIG. 5B. The description of a working principle of the auxiliary pixel drive circuit 100 will be given by taking an example in which the auxiliary pixel drive circuit 100 drives the plurality of auxiliary sub-pixels 102 in the first to third composite pixel rows (i.e., N1=5, N3=7, Y1=0 or 1) to emit light, and the transistors in pixel drive circuit 100 are P-type transistors.

When the fourth stage scanning signal Scan(4) is at a low level, the first initialization transistor Ts4 and the second initialization transistor Ts9 are turned on in response to the fourth stage scanning signal Scan(4) loaded by the fourth stage scanning signal line S(4). The first reset signal VI1 loaded by the first reset signal line VIL1 is transmitted to the gate of the auxiliary drive transistor Tsd to initialize the gate voltage of the auxiliary drive transistor Tsd. The third initialization transistor Tm4 and the fourth initialization transistor Tm9 in the main pixel drive circuit 200 corresponding to the main sub-pixel 202 disposed in the first composite pixel row are turned on in response to the fourth stage scanning signal Scan(4) loaded by the fourth stage scanning signal line S(4). The second reset signal VI2 loaded by the second reset signal line VIL2 is transmitted to the gate of the main drive transistor Tmd in the main pixel drive circuit 200 corresponding to the main sub-pixel 202 in the first composite pixel row to initialize the gate voltage of the main drive transistor Tmd.

When the fifth stage scanning signal Scan(5) or the sixth stage scanning signal Scan(6) is at a low level, the first data transistor Ts2, the first compensation transistor Ts3, and the second compensation transistor Ts8 are turned on in response to the fifth stage scanning signal Scan(5) or the sixth stage scanning signal Scan(6). The first data signal Data1 having a function of compensating the threshold voltage is transmitted to the gate of the auxiliary drive transistor Tsd. The first storage capacitor Cs1 is charged. The auxiliary drive transistor Tsd is turned on. The first storage capacitor Cs1 holds the gate voltage of the auxiliary drive transistor Tsd. Thus, the compensation of the threshold voltage of the auxiliary drive transistor Tsd is realized. The first data transistor Ts2, the first compensation transistor Ts3, and the second compensation transistor Ts8 are turned on in response to the fifth stage scanning signal Scan(5), or in response to the sixth stage scanning signal Scan(6).

The second data transistor Tm2, the second reset transistor Tm5, the third compensation transistor Tm3, and the fourth compensation transistor Tm8 in the main pixel drive circuit 200 corresponding to the main sub-pixel 202 disposed in the first composite pixel row are turned on in response to the fifth stage scanning signal Scan(5) loaded by the fifth stage scanning signal line S(5). The second data signal Data2 having a function of compensating the threshold voltage is transmitted to the gate of the main drive transistor Tmd of the main pixel drive circuit 200 corresponding to the main sub-pixel 202 disposed in the first composite pixel row. Thus, the compensation of the threshold voltage of the main drive transistor Tmd is realized. The second reset signal VI2 is transmitted to the anode of the corresponding main sub-pixel 202 to reset the anode voltage of the main sub-pixel 202. The third initialization transistor Tm4 and the fourth initialization transistor Tm9 in the main pixel drive circuit 200 corresponding to the main sub-pixel 202 disposed in the second composite pixel row are turned on in response to the fifth stage scanning signal Scan(5) loaded by the fifth stage scanning signal line S(5). The second reset signal VI2 loaded by the second reset signal line VIL2 is transmitted to the gate of the main drive transistor Tmd of the main pixel drive circuit 200 corresponding to the main sub-pixel 202 in the second composite pixel row to initialize the gate voltage of the main drive transistor Tmd. When the second light-emitting control signal EM2 is at a low level, the third switch transistor Tm6 and the fourth switch transistor Tm7 in the main pixel drive circuit 200 corresponding to the main sub-pixel 202 disposed in the first composite pixel row are turned on in response to the second light-emitting control signal EM2 loaded by the second light-emitting control signal line EML2. The main drive transistor Tmd in the main pixel drive circuit 200 corresponding to the main sub-pixel 202 disposed in the first composite pixel row drives the corresponding main sub-pixel 202 to emit light according to the second data signal Data2.

The second data transistor Tm2, the second reset transistor Tm5, the third compensation transistor Tm3, and the fourth compensation transistor Tm8 in the main pixel drive circuit 200 corresponding to the main sub-pixel 202 disposed in the second composite pixel row are turned on in response to the sixth stage scanning signal Scan(6) loaded by the sixth stage scanning signal line S(6). The second data signal Data2 with a function of compensating the threshold voltage is transmitted to the gate of the main drive transistor Tmd in the main pixel drive circuit 200 corresponding to the main sub-pixel 202 disposed in the second composite pixel row, thereby realizing the compensation of the threshold voltage of the main drive transistor Tmd. The second reset signal VI2 is transmitted to the anode of the corresponding main sub-pixel 202 to reset the anode voltage of the main sub-pixel 202. The third initialization transistor Tm4 and the fourth initialization transistor Tm9 in the main pixel drive circuit 200 corresponding to the main sub-pixel 202 disposed in the third composite pixel row are turned on in response to the sixth stage scanning signal Scan(6) loaded by the sixth stage scanning signal line S(6). The second reset signal VI2 loaded by the second reset signal line VIL2 is transmitted to the gate of the main drive transistor Tmd in the main pixel drive circuit 200 corresponding to the main sub-pixel 202 disposed in the third composite pixel row to initialize the gate voltage of the main drive transistor Tmd. When the second light-emitting control signal EM2 is at a low level, the third switch transistor Tm6 and the fourth switch transistor Tm7 in the main pixel drive circuit 200 corresponding to the main sub-pixel 202 disposed in the second composite pixel row are turned on in response to the second light-emitting control signal EM2 loaded by the second light-emitting control signal line EML2. The main drive transistor Tmd in the main pixel drive circuit 200 corresponding to the main sub-pixel 202 disposed in the second composite pixel row drives the corresponding main sub-pixel 202 to emit light according to the second data signal Data2.

When the seventh stage scanning signal Scan(7) is at a low level, the first reset transistor Ts5 is turned on in response to the seventh stage scanning signal Scan(7) loaded by the seventh stage scanning signal line S(7). The first reset transistor Ts5 is turned on so that the first reset signal VI1 is transmitted to the anodes of the plurality of auxiliary sub-pixels 102, thereby realizing the initialization of the anode voltages of the plurality of auxiliary sub-pixels 102. The second data transistor Tm2, the second reset transistor Tm5, the third compensation transistor Tm3, and the fourth compensation transistor Tm8 in the main pixel drive circuit 200 corresponding to the main sub-pixel 202 disposed in the third composite pixel row are turned on in response to the seventh stage scanning signal Scan(7) loaded by the seventh stage scanning signal line S(7). The second data signal Data2 with a function of compensating the threshold voltage is transmitted to the gate of the main drive transistor Tmd in the main pixel drive circuit 200 corresponding to the main sub-pixel 202 in the third composite pixel row, so as to realize the compensation of the threshold voltage of the main drive transistor Tmd. The second reset signal VI2 is transmitted to the anodes of the corresponding main sub-pixels 202 to reset the anode voltages of the main sub-pixels 202.

When the first light-emitting control signal EM1 is at a low level, the first switch transistor Ts6 and the second switch transistor Ts7 are turned on in response to the first light-emitting control signal EM1 loaded by the first light-emitting control signal line EML1. The auxiliary drive transistor Tsd drives the plurality of auxiliary sub-pixels 102 to emit light according to the first data signal Data1. When the second light-emitting control signal EM2 is at a low level, the third switch transistor Tm6 and the fourth switch transistor Tm7 in the main pixel drive circuit 200 corresponding to the main sub-pixel 202 disposed in the third composite pixel row are turned on in response to the second light-emitting control signal EM2 loaded by the second light-emitting control signal line EML2. The main drive transistor Tmd in the main pixel drive circuit 200 corresponding to the main sub-pixel 202 disposed in the third composite pixel row drives the corresponding main sub-pixel 202 to emit light according to the second data signal Data2.

The working principle of the auxiliary pixel drive circuit 100 shown in FIG. 4A is similar to the working principle of the auxiliary pixel drive circuit 100 shown in FIG. 4B, and will not be repeated here.

Please refer to FIG. 2A to FIG. 2B and FIG. 4A to FIG. 4G, the display panel includes the plurality of composite pixel rows 101. For driving the plurality of auxiliary sub-pixels 102 in the plurality of composite pixel rows 101 to emit light, the plurality of auxiliary pixel drive circuits 100 can drive the plurality of auxiliary sub-pixels 102 in the same number of the composite pixel rows 101 to emit light, or the plurality of auxiliary pixel drive circuits 100 can drive the plurality of auxiliary sub-pixels 102 in different numbers of the composite pixel rows 101 to emit light. Thus, the auxiliary pixel drive circuits 100 can drive the plurality of auxiliary sub-pixels 102 of all the composite pixel rows 101 to emit light.

Specifically, the auxiliary pixel drive circuit 100 includes a first auxiliary pixel drive circuit and a second auxiliary pixel drive circuit. The first auxiliary pixel drive circuit drives the plurality of auxiliary sub-pixels 102 in Z1 of the composite pixel rows 101 to emit light. The second auxiliary pixel drive circuit drives the plurality of auxiliary sub-pixels 102 in Z2 of the composite pixel rows 101 to emit light. Z1>1 and Z2>1. Z1 and Z2 are both odd numbers. Alternatively, Z1 and Z2 are both even numbers. Alternatively, Z1 is one of odd or even numbers, and Z2 is the other of odd or even numbers.

The description will be given by taking an example in which the fifth pixel row is the first composite pixel row 1011, Z1=2 (i.e., Z1 is an even number), Z2=3 (i.e., Z2 is an odd number), the first auxiliary pixel drive circuit drives the plurality of auxiliary sub-pixels 102 in the first to second composite pixel rows 101 (i.e., N1=5, N2=6, Y=0) to emit light, and the second auxiliary pixel drive circuit drives the plurality of auxiliary sub-pixels 102 in the third to fifth composite pixel rows 101 (i.e., N3=7, N5=9, Y1=0 or 1) to emit light.

A first initialization module of the first auxiliary pixel drive circuit is configured to transmit the first reset signal VI1 to a gate of an auxiliary drive transistor of the first auxiliary pixel drive circuit according to the fourth stage scanning signal Scan(4) to initialize the gate voltage of the auxiliary drive transistor. A first data write module of the first auxiliary pixel drive circuit is configured to transmit the first data signal Data1 to one of the source or the drain of the auxiliary drive transistor according to fifth stage scanning signal Scan(5). A first reset module of the first auxiliary pixel drive circuit is configured to transmit the first reset signal VI1 to the anodes of the plurality of auxiliary sub-pixels 102 according to the sixth stage scanning signal Scan(6) to reset the anodes of the plurality of auxiliary sub-pixels 102.

A first initialization module of the second auxiliary pixel drive circuit is configured to transmit the first reset signal VI1 to a gate of an auxiliary drive transistor of the second auxiliary pixel drive circuit according to the sixth stage scanning signal Scan(6) to initialize the gate voltage of the auxiliary drive transistor. A first data write module of the second auxiliary pixel drive circuit is configured to transmit the first data signal Data1 to one of the source or the drain of the auxiliary drive transistor according to the seventh stage scanning signal Scan(7) or an eighth stage scanning signal Scan(8). A first reset module of the second auxiliary pixel drive circuit is configured to transmit the first reset signal VI1 to the anodes of the plurality of auxiliary sub-pixels 102 according to a ninth stage scanning signal Scan (9) to reset the anodes of the plurality of auxiliary sub-pixels 102.

Similarly, it is also possible to obtain embodiments in which Z1 and Z2 are both odd numbers, Z1 and Z2 are both even numbers, Z1 is an odd number and Z2 is an even number, which will not be repeated here.

Based on the above-mentioned scanning signal lines connected to the auxiliary pixel drive circuit and the main pixel drive circuit corresponding to the auxiliary sub-pixel and the main sub-pixel arranged on a same composite pixel row, the used analysis content of the scanning signals, schematic diagrams of the connection between gate drive circuits, main pixel drive circuits, and auxiliary pixel drive circuits as shown in FIG. 6A to FIG. 6C can be obtained.

Specifically, the description will be given by taking an example in which the (M+1)th pixel row is the first composite pixel row.

The gate drive circuit 300 provides a M-th stage scanning signal Scan(M) and a (M+1)th stage scanning signal Scan (M+1) to the main pixel drive circuit 200 that drives the main sub-pixel 202 in the first composite pixel row 101 (i.e., i=1, N1=M+1) to emit light. The gate drive circuit 300 provides the (M+1)th stage scanning signal Scan(M+1) and a (M+2)th stage scanning signal Scan(M+2) to the main pixel drive circuit 200 that drives the main sub-pixel 202 in the second composite pixel row 101 (i.e., i=2, N2=M+2) to emit light. By analogy, the gate drive circuit 300 provides a (M+i−1)th stage scanning signal Scan(M+i−1) and a (M+i) th stage scanning signal Scan(M+i) to the main pixel drive circuit 200 that drives the main sub-pixel 202 in the i-th composite pixel row 101 (i.e., Ni=M+i) to emit light.

As shown in FIG. 6A, each of the auxiliary pixel drive circuits 201 drives the plurality of auxiliary sub-pixels 102 in two composite pixel rows (i.e., q−p+1=2) to emit light. The gate drive circuit 300 provides the M-th stage scanning signal Scan(M), the (M+1)th stage scanning signal Scan(M+1), and a (M+2)th stage scanning signal Scan(M+2) to the auxiliary pixel drive circuit 201 that drives the plurality of auxiliary sub-pixels 102 in the first to second composite pixel rows 101 (i.e., p=1, q=2, N1=M+1, N2=M+2, Y<q−p) to emit light. The gate drive circuit 300 provides the (M+2)th stage scanning signal Scan(M+2), a (M+3)th stage scanning signal Scan(M+3), and a (M+4)th stage scanning signal Scan(M+4) to the auxiliary pixel drive circuit 201 that drives the plurality of auxiliary sub-pixels 102 in the third to fourth composite pixel rows 101 (i.e., p=3, q=4, N3=M+3, N4=M+4) to emit light. By analogy, the gate drive circuit 300 provides a (M+p−1)th stage scanning signal Scan(M+p−1), a (M+p+Y)th stage scanning signal Scan(M+p+Y), and a (M+q)th stage scanning signal Scan(M+q) to the auxiliary pixel drive circuit 201 that drives the plurality of auxiliary sub-pixels 102 in the p-th to q-th composite pixel rows 101 (i.e., Np=M+p, Nq=M+q) to emit light.

As shown in FIG. 6B to FIG. 6C, if each of the auxiliary pixel drive circuits 201 drives the plurality of auxiliary sub-pixels 102 in three composite pixel rows (i.e., q−p+1=3) to emit light, the gate drive circuit 300 provides the M-th stage scanning signal Scan(M) and the (M+1)th stage scanning signal Scan(M+1) or the (M+2)th stage scanning signal Scan(M+2) and the (M+3)th stage scanning signal Scan(M+3) to the auxiliary pixel drive circuit 201 that drives the plurality of auxiliary sub-pixels 102 in the first to third composite pixel rows 101 (i.e., p=1, q=3, Np=M+1, Nq=M+

3, Y<q−p) to emit light. The gate drive circuit 300 provides the (M+3)th stage scanning signal Scan(M+3) and the (M+4)th stage scanning signal Scan(M+4) or a (M+5)th stage scanning signal Scan(M+5) and a (M+6)th stage scanning signal Scan(M+6) to the auxiliary pixel drive circuit 201 that drives the plurality of auxiliary sub-pixels 102 in the fourth to sixth composite pixel rows 101 (i.e., p=4, q=6, Np=M+4, Nq=M+6) to emit light. By analogy, the gate drive circuit 300 provides the (M+p−1)th stage scanning signal Scan(M+p−1), the (M+p+Y)th stage scanning signal Scan(M+p+Y), and the (M+q)th stage scanning signal Scan(M+q) to the auxiliary pixel drive circuit 201 that drives the plurality of auxiliary sub-pixels 102 in the p-th to q-th composite pixel rows 101 (i.e., Np=M+p, Nq=M+q) to emit light.

Furthermore, one of the auxiliary pixel drive circuits 201 drives the plurality of auxiliary sub-pixels 102 in Z of the composite pixel rows (i.e., q−p+1=Z) to emit light. The gate drive circuit 300 provides the (M+p−1)th stage scanning signal Scan(M+p−1), the (M+p+Y)th stage scanning signal Scan(M+p+Y), and the (M+q)th stage scanning signal Scan (M+q) to the auxiliary pixel drive circuit 201 that drives the plurality of auxiliary sub-pixels 102 in the p-th to q-th composite pixel rows 101 (i.e., Np=M+p, Nq=M+q) to emit light, where 0≤Y<q−p, 0≤Y<Nq−Np, and Y<Z−1.

Figure 7:
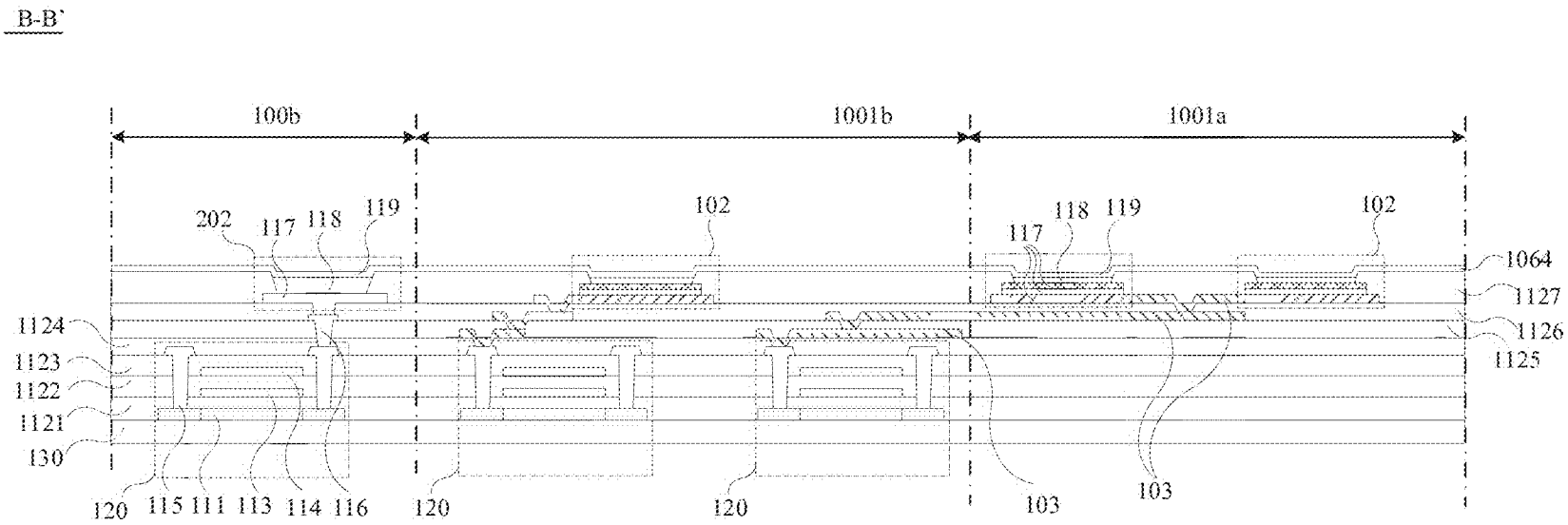
FIG. 7 is a cross-sectional view taken along a line B-B' in FIG. 1A.

FIG. 7 is a cross-sectional view taken along a line B-B' in FIG. 1A. The display panel includes a substrate 130. The gate drive circuits 300, the main pixel drive circuits 200, and the auxiliary pixel drive circuits are all disposed on the substrate 130. Each of the gate drive circuits 300, each of the main pixel drive circuits 200, and each of the auxiliary pixel drive circuits 100 includes a plurality of transistors 120.

The display panel further includes an active layer 111, a first gate insulating layer (GI1) 1121, a first gate layer (GE1) 113, a second gate insulating layer (GI2) 1122, a second gate layer (GE2) 114, a dielectric insulating layer (ILD) 1123, a first source/drain layer (SD1) 115, a passivation layer (PV) 1124, a first planarization layer (PLN1) 1125, a second source/drain layer (SD2) 116, a second planarization layer (PLN2) 1126, an anode (ANO) 117, a pixel definition layer 1127, a light-emitting layer 118, and a cathode 119 disposed on the substrate 130.

The first gate layer 113 includes a first trace and a first electrode corresponding to the active layer. The second gate layer 114 includes a second trace and a second electrode corresponding to the active layer. The first trace includes scanning signal lines that transmit scanning signals. The first electrode and the second electrode together form a capacitor. The first source/drain layer 115 includes a third trace and a source/drain electrically connected to the active layer 111. The second source/drain layer 116 includes a fourth trace. The third trace includes data signal lines for transmitting data signals. The fourth trace includes a power signal line connected to the first voltage terminal and the second voltage terminal.

The auxiliary sub-pixel 102 and the main sub-pixel 202 both include the anode 117, the light-emitting layer 118, and the cathode 119.

Alternatively, the anode of the auxiliary sub-pixel 102 includes a first transparent layer, a second transparent layer, and a reflective layer disposed between the first transparent layer and the second transparent layer. Alternatively, the first transparent layer is arranged in the same layer as the second connection line of the connection line 103. An orthographic projection of the second transparent layer and the reflective layer is located within a boundary of the first transparent layer.

Each of the transistors 120 includes the active layer 111, the first electrode, the second electrode, and the source/drain.

Alternatively, the light-emitting layer 118 includes fluorescent materials, perovskite materials, quantum dot materials, and the like.

Figure 8A:
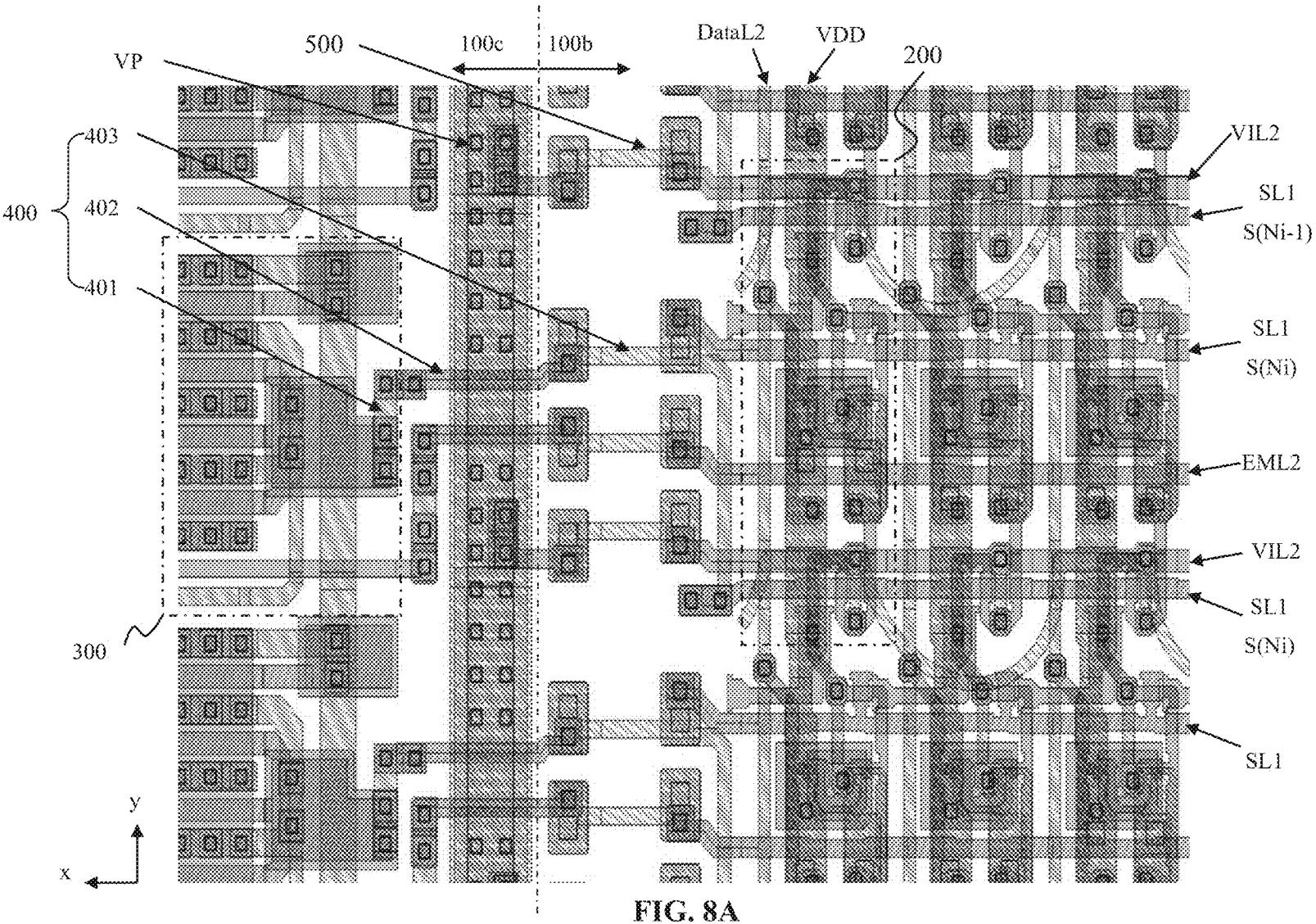
FIG. 8A is a partial schematic diagram of the gate drive circuits and the main pixel drive circuits connected to each other through a plurality of scanning signal lines of the embodiment of the present disclosure.
Figure 8B:
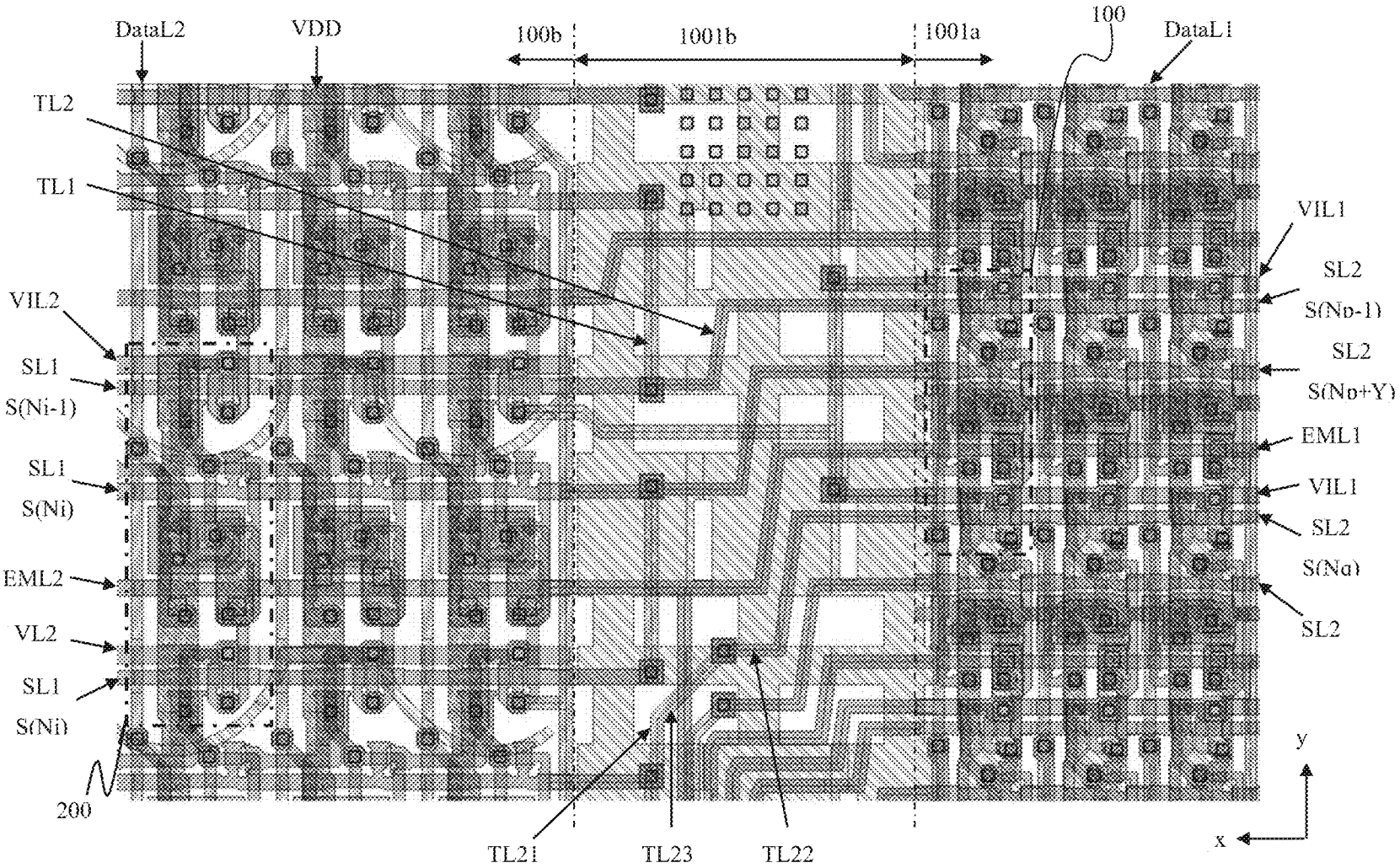
FIG. 8B is a partial schematic diagram of the gate drive circuits and the auxiliary pixel drive circuits connected to each other through the plurality of scanning signal lines of the embodiment of the present disclosure.

FIG. 8A is a partial schematic diagram of the gate drive circuits and the main pixel drive circuits connected to each other through a plurality of scanning signal lines of the embodiment of the present disclosure. FIG. 8B is a partial schematic diagram of the gate drive circuits and the auxiliary pixel drive circuits connected to each other through the plurality of scanning signal lines of the embodiment of the present disclosure. FIG. 6A to FIG. 6C only show the connections between the gate drive circuits 300, the main pixel drive circuits 200, and the auxiliary pixel drive circuits 100 in a simplified schematic manner. However, in practical applications, the connections of the gate drive circuits 300, the main pixel drive circuits 200, and the auxiliary pixel drive circuits 100 can be referred to as shown in FIG. 8A to FIG. 8B. FIG. 8A only shows a part of devices of the gate drive circuits 300.

Specifically, please refer to FIG. 7 and FIG. 8A. The display panel includes a plurality of connection lines 400. Each of the connection lines 400 is connected to the corresponding gate drive circuit 300 and extends in a direction from the non-display area 100*c* toward the main display area 100*b*. Each of the gate drive circuits 300 is connected to a corresponding scanning signal line through the connection line 400.

Furthermore, the connection line 400 includes a first connection line 401, a second connection line 402, and a third connection line 403. The first connection line 401 is disposed in the non-display area 100*c* and is electrically connected to the gate drive circuit 300. The second connection line 402 is electrically connected to the first connection line 401 and extends in a direction from the non-display area 100*c* toward the main display area 100*b*. The third connection line 403 is disposed in the main display area 100*b* and is electrically connected to the scanning signal line.

Alternatively, the first connection line 401 is formed by the first source/drain layer 115. The second connection line 402 is formed by the first gate layer 113. The first connection line 401 is electrically connected to an upper electrode plate layer of the capacitor in the gate drive circuit 300 through a via hole that extends through the dielectric insulating layer 1123, and is also electrically connected to the second connection line 402 through a via hole that extends through the dielectric insulating layer 1123 and the second gate insulating layer 1122.

Alternatively, the third connection line 403 may be formed by a multi-layer electrical connection line. Specifically, the third connection line 403 includes a first sub-connection line, a second sub-connection line, and the third sub-connection line. The first sub-connection line and the third sub-connection line are formed by the first source/drain layer 115. The second sub-connection line is formed by the second source/drain layer 116. The first sub-connection line is connected to the second connection line 402 and the second sub-connection line. The first sub-connection line and the third sub-connection line are disposed in the via hole that extends through the dielectric insulating layer 1123 and the second gate insulating layer 1122. The second sub-connection line is connected to the first sub-connection line and the third sub-connection line through a via hole that extends through the passivation layer 1124 and the first planarization layer 1125. The third sub-connection line is connected to the second sub-connection line and the scanning signal line.

Alternatively, a reset voltage terminal interface VP is disposed between the gate drive circuit 300 and the main pixel drive circuit 200, so that the reset signal line 500 is connected to the first reset voltage terminal VIL1 or the second reset voltage terminal VIL2.

Referring to FIG. 8A to FIG. 8B, the plurality of scanning signal lines include a plurality of first scanning signal lines SL1 and a plurality of second scanning signal lines SL2. Each of the main pixel drive circuits 200 is connected to the corresponding gate drive circuit 300 through the corresponding first scanning signal line SL1. Each of the auxiliary pixel drive circuits 1001 is connected to the corresponding gate drive circuit 300 through the corresponding second scanning signal line SL2 in connection with the corresponding first scanning signal line SL1. Each of the second scanning signal lines SL2 is electrically connected to the corresponding first scanning signal line SL1 in the transition display area 1001*b*.

Furthermore, referring to FIG. 8B, the display panel also includes a plurality of transitional connection lines, so that each of the auxiliary pixel drive circuits 100 is connected to the corresponding gate drive circuit 300 through the corresponding second scanning signal line SL2 in connection with the corresponding first scanning signal line SL1.

Specifically, the plurality of transitional connection lines include a plurality of first transitional connection lines TL1 and a plurality of second transitional connection lines TL2. Each of the first transitional connection lines TL1 is electrically connected to two of the first scanning signal lines SL1 that transmit a same scanning signal. Each of the second transitional connection lines TL2 is electrically connected to the first scanning signal line SL1 and the second scanning signal line SL2 that transmit a same scanning signal.

Furthermore, at least one of the second transitional connection lines TL2 includes a first transition section TL21, a second transition section TL22, and a third transition section TL23. The first transition section TL21 is connected to the corresponding first scanning signal line SL1. The second transition section TL22 is connected to the corresponding second scanning signal line SL2. The third transition section TL23 is connected to the first transition section TL21 and the second transition section TL22. The second transition section TL 22 is inclined relative to the first transition section TL 21 and the third transition section TL 23, so as to connect the main pixel drive circuit 200 and the auxiliary pixel drive circuit 100 disposed on different horizontal lines to realize the transmission of scanning signals.

The first data signal line DataL1, the second data signal line DataL2, and a power signal line extend along a second direction y. The power signal line is connected to the first voltage terminal VDD. The first scanning signal line SL1, the second scanning signal line SL2, the first light-emitting signal control line EML1, the second light-emitting signal control line EML2, and the reset signal line 500 extend along a first direction x that intersects with the second direction y. The reset signal line 500 is connected to the first reset voltage terminal VIL1 or the second reset voltage terminal VIL2.

Furthermore, since there is the bending line boundary 100*d* between the main display area 100*b* and the functional additional area 100*a*, the first heights of the plurality of second bending sides 1002*d* are sequentially reduced in a direction away from the first symmetry axis a1, and a wiring space of the transitional connection lines is also reduced accordingly. Therefore, in order to ensure that the plurality of auxiliary pixel drive circuits 100 can be connected to the corresponding scanning signal lines, an arrangement density of the plurality of second transitional connection lines TL2 can be gradually reduced in a direction away from the first symmetry axis a1 and/or the second symmetry axis a2.

An embodiment of the present disclosure also provides a display device including the above-mentioned display panels.

Furthermore, the display device also includes a sensor. The sensor is disposed facing the display and light transmitting area of the display panel. The sensor includes a fingerprint recognition sensor, a camera, a structured light sensor, a time-of-flight sensor, a distance sensor, a light sensor, etc. The sensor can acquire signals through the display and light transmitting area, so that the display device can realize under-screen sensing solutions, such as under-screen fingerprint recognition, under-screen camera, under-screen facial recognition, under-screen distance sensing, etc.

Furthermore, the display device also includes a touch panel. The touch panel is combined with the display panel in a built-in or externally mounted manner, so that the display device has a touch function.

The display device includes a fixed terminal (e.g., a TV and a desktop computer), a mobile terminal (e.g., a cell phone and a laptop), and a wearable device (e.g., a bracelet, a virtual reality (VR) device, an augmented reality (AR) device).

In the foregoing embodiments, the description of each embodiment has its own focus. For parts that are not described in detail in a certain embodiment, reference may be made to related descriptions in other embodiments. The description of the above embodiments is only used to help understand the technical solution of the present disclosure and its core idea. Those of ordinary skill in the art should understand that the technical solutions described in the foregoing embodiments can still be modified, or some of the technical features thereof can be equivalently replaced. However, these modifications or replacements do not cause an essence of the corresponding technical solutions to deviate from a scope of the technical solutions of the embodiments of the present disclosure.

What is claimed is:

1. A display panel, comprising a functional additional area and a main display area disposed on a periphery of the functional additional area, wherein the display panel comprises:

a plurality of pixel rows comprising a plurality of composite pixel rows, wherein each of the composite pixel rows comprises a plurality of auxiliary sub-pixels disposed in the functional additional area and a plurality of main sub-pixels disposed in the main display area;

a plurality of auxiliary pixel drive circuits, wherein each of the auxiliary pixel drive circuits is connected to the plurality of auxiliary sub-pixels to correspondingly drive the plurality of auxiliary sub-pixels to emit light;

a plurality of main pixel drive circuits, wherein each of the main pixel drive circuits is connected to a corresponding main sub-pixel to drive the corresponding main sub-pixel to emit light; and a plurality of stages of gate drive circuits connected to the plurality of auxiliary pixel drive circuits and the plurality of main pixel drive circuits through a plurality of scanning signal lines, wherein scanning signal lines connected to the auxiliary pixel drive circuit and the main pixel drive circuit corresponding to the auxiliary sub-pixel and the main sub-pixel arranged on a same composite pixel row are different.

2. The display panel according to claim 1, wherein each of the main pixel drive circuits is connected to X1 of the gate drive circuits, and each of the auxiliary pixel drive circuits is connected to X2 of the gate drive circuits, and wherein X1≥2, X2≥3, and X2>X1.

3. The display panel according to claim 1, wherein an arrangement structure of the plurality of auxiliary sub-pixels disposed in the functional additional area is the same as an arrangement structure of the plurality of main sub-pixels disposed in the main display area.

4. The display panel according to claim 1, wherein each of the auxiliary pixel drive circuits and each of the main pixel drive circuits have a same circuit topology.

5. The display panel according to claim 1, wherein a smallest stage scanning signal line of the plurality of scanning signal lines connected to the auxiliary pixel drive circuit connected to the plurality of auxiliary sub-pixels in a p-th composite pixel row to a q-th composite pixel row is connected to one of the main pixel drive circuits corresponding to the main sub-pixel in the p-th composite pixel row;

wherein a largest stage scanning signal line of the plurality of scanning signal lines connected to the auxiliary pixel drive circuit connected to the plurality of auxiliary sub-pixels in the p-th composite pixel row to the q-th composite pixel row is connected to one of the main pixel drive circuits corresponding to the main sub-pixel in the q-th composite pixel row; and wherein p≥1, and q>p.

6. The display panel according to claim 5, wherein a (M+1)th pixel row is a first composite pixel row of the plurality of composite pixel rows;

the auxiliary pixel drive circuit connected to the plurality of auxiliary sub-pixels in the p-th composite pixel row to the q-th composite pixel row is connected to an (Np−1)th stage scanning signal line, an (Np+Y)th stage scanning signal line, and an Nq-th stage scanning signal line;

the main pixel drive circuit corresponding to the main sub-pixel in an i-th composite pixel row is connected to an (Ni−1)th stage scanning signal line and an Ni-th stage scanning signal line; and $$Np=M+p, Nq=M+q, Ni=M+i; 0\leq Y<Nq-Np; p\leq i\leq q.$$

7. The display panel according to claim 1, wherein the plurality of main pixel drive circuits is disposed in the main display area; and the functional additional area comprises a display and light transmitting area and a transition display area disposed on a periphery of the display and light transmitting area, and the plurality of auxiliary pixel drive circuits are disposed in the transition display area.

8. The display panel according to claim 7, wherein the plurality of scanning signal lines comprise a plurality of first scanning signal lines and a plurality of second scanning signal lines, each of the main pixel drive circuits is connected to a corresponding gate drive circuit through a corresponding first scanning signal line, each of the auxiliary pixel drive circuits is connected to a corresponding gate drive circuit through a corresponding second scanning signal line in connection with a corresponding first scanning signal line, and each of the second scanning signal lines and a corresponding first scanning signal line are electrically connected in the transition display area.

9. The display panel according to claim 8, further comprising a plurality of first transitional connection lines, wherein each of the first transitional connection lines is electrically connected to two of the first scanning signal lines that transmit a same scanning signal.

10. The display panel according to claim 8, further comprising a plurality of second transitional connection lines, wherein each of the second transitional connection lines is electrically connected to one of the first scanning signal lines and one of the second scanning signal lines that transmit a same scanning signal.

11. The display panel according to claim 10, wherein at least one of the second transitional connection lines comprises:

a first transition section connected to a corresponding first scanning signal line;

a second transition section connected to a corresponding second scanning signal line; and a third transition section connected to the first transition section and the second transition section, wherein the second transition section is inclined relative to the first transition section and the third transition section.

12. The display panel according to claim 10, wherein there is a bending line boundary between the main display area and the functional additional area, the bending line boundary comprises a plurality of first bending sides and a plurality of second bending sides that intersect perpendicularly to one another, the functional additional area comprises a first symmetry axis parallel to the first bending sides and a second symmetry axis parallel to the second bending sides and intersecting with the first symmetry axis, an intersection point of the first symmetry axis and the second symmetry axis is located at a center of the functional additional area, and an arrangement density of the plurality of second transitional connection lines gradually decreases in a direction away from the first symmetry axis and/or the second symmetry axis.

13. The display panel according to claim 12, wherein each of the first bending sides has a first length, the first lengths of the plurality of first bending sides sequentially decrease in a direction away from the second symmetry axis, each of the second bending sides has a first height, and the first heights of the plurality of second bending sides sequentially decrease in a direction away from the first symmetry axis.

14. The display panel according to claim 1, wherein a (M+1)th pixel row is a first composite pixel row in the plurality of composite pixel rows, and the auxiliary pixel drive circuit connected to the plurality of auxiliary sub-pixels disposed in the p-th composite pixel row to the q-th composite pixel row comprises:

a first drive module comprising an auxiliary drive transistor;

a first initialization module connected between a first reset voltage terminal and a gate of the auxiliary drive transistor and configured to transmitting a first reset signal to the gate of the auxiliary drive transistor according to an (Np−1)th stage scanning signal to initialize a gate voltage of the auxiliary drive transistor;

a first data write module connected between a first data signal line and one of a source or a drain of the auxiliary drive transistor for transmitting a first data signal to one of the source or the drain of the auxiliary drive transistor according to an (Np+Y)th stage scanning signal;

a first reset module connected between the first reset voltage terminal and anodes of corresponding plurality of auxiliary sub-pixels for transmitting a first reset signal to the anodes the plurality of auxiliary sub-pixels according to an Nq-th stage scanning signal to reset anode voltages of the plurality of auxiliary sub-pixels;

a first compensation module connected between the gate of the auxiliary drive transistor and one of the source or the drain of the auxiliary drive transistor, and configured to transmit the first data signal to the gate of the auxiliary drive transistor according to the (Np+Y)th stage scanning signal to compensate a threshold voltage of the auxiliary drive transistor;

a first storage module connected in series between the gate of the auxiliary drive transistor and a first voltage terminal, and configured to maintain the gate voltage of the auxiliary drive transistor; and a first light-emitting control module connected to the auxiliary drive transistor in series, and configured to control the plurality of auxiliary sub-pixels to emit light according to a first light-emitting control signal, wherein $Np=M+p, Nq=M+q; 0\leq Y<Nq-Np, p\geq 1, q>p$.

15. The display panel according to claim 14, wherein the first initialization module comprises a first initialization transistor, a gate of the first initialization transistor is connected to an (Np−1)th stage scanning signal line, one of a source or a drain of the first initialization transistor is connected to the gate of the auxiliary drive transistor, and the other of the source or the drain of the first initialization transistor is connected to the first reset voltage terminal;

the first data write module comprises a first data transistor, a gate of the first data transistor is connected to an (Np+Y)th stage scanning signal line, one of a source or a drain of the first data transistor is connected to the first data line, and the other of the source or the drain of the first data transistor is connected to one of the source or the drain of the auxiliary drive transistor;

the first compensation module comprises a first compensation transistor, a gate of the first compensation transistor is connected to the (Np+Y)th stage scanning signal line, one of a source or a drain of the first compensation transistor is electrically connected to the gate of the auxiliary drive transistor, and the other of the source or the drain of the first compensation transistor is connected to the other of the source or the drain of the auxiliary drive transistor;

the first reset module comprises a first reset transistor, a gate of the first reset transistor is connected to an Nq-th stage scanning signal line, one of a source or a drain of the first reset transistor is connected to the first reset voltage terminal, and the other of the source or the drain of the first reset transistor is connected to the anodes of the corresponding plurality of auxiliary sub-pixels;

the first light-emitting control module comprises a first switch transistor and a second switch transistor, a gate of the first switch transistor is connected to a first light-emitting signal control line, one of a source or a drain of the first switch transistor is connected to the other of the source or the drain of the auxiliary drive transistor and the other of the source or the drain of the compensation transistor, the other of the source or the drain of the first switch transistor is connected to the anodes of the corresponding plurality of auxiliary sub-pixels; a gate of the second switch transistor is connected to the first light-emitting signal control line, one of a source or a drain of the second switch transistor is connected to the first voltage terminal, the other of the source or the drain of the second switch transistor is connected to one of the source or the drain of the auxiliary drive transistor and one of the source or the drain of the first data transistor;

the first storage module comprises a first storage capacitor, and the first storage capacitor is connected in series between the first voltage terminal and the gate of the auxiliary drive transistor; and a cathode of each of the auxiliary sub-pixels is connected to a second voltage terminal.

16. The display panel according to claim 1, wherein the main pixel drive circuit connected to one of the main sub-pixels in an Ni-th pixel row comprises:

a second drive module comprising a main drive transistor;

a second initialization module connected between a second reset voltage terminal and a gate of the main drive transistor, and configured to transmit a second reset signal to the gate of the main drive transistor according to an (Ni−1)th stage scanning signal to initialize a gate voltage of the main drive transistor;

a second data write module connected between a second data signal line and one of a source or a drain of the main drive transistor, and configured to transmit a second data signal to one of the source or the drain of the main drive transistor according to the (Ni−1)th stage scanning signal;

a second reset module connected between the second reset voltage terminal and an anode of a corresponding main sub-pixel, and configured to transmit the second reset signal to the anode of the main sub-pixel according to the (Ni−1)th stage scanning signal to reset an anode voltage of the main sub-pixel;

a second compensation module connected between the gate of the main drive transistor and one of the source or the drain of the main drive transistor, and configured to transmit the second data signal to the gate of the main drive transistor according to the (Ni−1)th stage scanning signal to compensate a threshold voltage of the main drive transistor;

a second storage module connected in series between the gate of the main drive transistor and the first voltage terminal, and configured to maintain the gate voltage of the main drive transistor; and a second light-emitting control module connected to the main drive transistor in series, and configured to control the main sub-pixel to emit light according to a second light-emitting control signal, wherein $Ni\geq 1, i\geq 1$.

17. The display panel according to claim 16, wherein the second initialization module comprises a third initialization transistor, a gate of the third initialization transistor is connected to an (Ni−1)th stage scanning signal line, one of a source or a drain of the third initialization transistor is connected to the gate of the main drive transistor, and the other of the source or the drain of the third initialization transistor is connected to the second reset voltage terminal;

the second data write module comprises a second data transistor, a gate of the second data transistor is connected to an Ni-th stage scanning signal line, one of a source or a drain of the second data transistor is connected to the second data line, and the other of the source or the drain of the second data transistor is connected to one of the source or the drain of the main drive transistor;

the second compensation module comprises a third compensation transistor, a gate of the third compensation transistor is connected to the Ni-th stage scanning signal line, one of a source or a drain of the third compensation transistor is electrically connected to the gate of the main drive transistor, and the other of the source or the drain of the third compensation transistor is connected to the other of the source or the drain of the main drive transistor;

the second reset module comprises a second reset transistor, a gate of the second reset transistor is connected to an Ni-th stage scanning signal line, one of a source or a drain of the second reset transistor is connected to the second reset voltage terminal, and the other of the source or the drain of the second reset transistor is connected to the anode of the corresponding main sub-pixel;

the second light-emitting control module comprises a third switch transistor and a fourth switch transistor, a gate of the third switch transistor is connected to a second light-emitting signal control line, one of a source or a drain of the third switch transistor is connected to the other of the source or the drain of the main drive transistor, the other of the source or the drain of the third switch transistor is connected to the anode of the corresponding main sub-pixel; a gate of the fourth switch transistor is connected to the second light-emitting signal control line, one of a source or a drain of the fourth switch transistor is connected to the first voltage terminal, the other of the source or the drain of the fourth switch transistor is connected to one of the source or the drain of the main drive transistor and one of the source or the drain of the second data transistor;

the second storage module comprises a second storage capacitor, and the second storage capacitor is connected in series between the first voltage terminal and the gate of the main drive transistor; and a cathode of the main sub-pixel is connected to a second voltage terminal.

18. The display panel according to claim 1, wherein the auxiliary pixel drive circuits comprise a first auxiliary pixel drive circuit and a second auxiliary pixel drive circuit, the first auxiliary pixel drive circuit is connected to the plurality of auxiliary sub-pixels in Z1 of the composite pixel rows, the second auxiliary pixel drive circuit is connected to the plurality of auxiliary sub-pixels in Z2 of the composite pixel rows; and wherein Z1>1, Z2>1; Z1 and Z2 are both odd numbers, or Z1 and Z2 are both even numbers, or Z1 is one of odd or even numbers, and Z2 is the other of odd or even numbers.

19. The display panel according to claim 1, wherein the plurality of main sub-pixels and the plurality of auxiliary sub-pixels arranged on a same composite pixel row are arranged on a same horizontal line; or a part of the main sub-pixels in the plurality of main sub-pixels and a part of the auxiliary sub-pixels in the plurality of auxiliary sub-pixels arranged on a same composite pixel row are arranged on a same horizontal line.

20. A display device, comprising a display panel, wherein the display panel comprises a functional additional area and a main display area disposed on a periphery of the functional additional area, wherein the display panel comprises:

a plurality of pixel rows comprising a plurality of composite pixel rows, wherein each of the composite pixel rows comprises a plurality of auxiliary sub-pixels disposed in the functional additional area and a plurality of main sub-pixels disposed in the main display area;

a plurality of auxiliary pixel drive circuits, wherein each of the auxiliary pixel drive circuits is connected to the plurality of auxiliary sub-pixels to correspondingly drive the plurality of auxiliary sub-pixels to emit light;

a plurality of main pixel drive circuits, wherein each of the main pixel drive circuits is connected to a corresponding main sub-pixel to drive the corresponding main sub-pixel to emit light; and a plurality of stages of gate drive circuits connected to the plurality of auxiliary pixel drive circuits and the plurality of main pixel drive circuits through a plurality of scanning signal lines, wherein scanning signal lines connected to the auxiliary pixel drive circuit and the main pixel drive circuit corresponding to the auxiliary sub-pixel and the main sub-pixel arranged on a same composite pixel row are different.

* * * * *